US012617591B2

(12) United States Patent
Nusbaum

(10) Patent No.: US 12,617,591 B2
(45) Date of Patent: May 5, 2026

(54) ASEPTIC CONTAINER CLOSURE HAVING A HINGE AND A MOUTHPIECE

(71) Applicant: BERICAP HOLDING GMBH, Budenheim (DE)

(72) Inventor: Philippe Nusbaum, Orthez (FR)

(73) Assignee: BERICAP HOLDING GMBH, Budenheim (DE)

( * ) Notice: Subject to any disclaimer, the term of this patent is extended or adjusted under 35 U.S.C. 154(b) by 195 days.

(21) Appl. No.: 18/549,425

(22) PCT Filed: Mar. 7, 2022

(86) PCT No.: PCT/EP2022/055746
§ 371 (c)(1),
(2) Date: Sep. 7, 2023

(87) PCT Pub. No.: WO2022/189353
PCT Pub. Date: Sep. 15, 2022

(65) Prior Publication Data

US 2024/0140659 A1 May 2, 2024

(30) Foreign Application Priority Data

Mar. 10, 2021 (DE) ..... 10 2021 105 870.8
May 28, 2021 (DE) ..... 10 2021 113 872.2
Dec. 7, 2021 (DE) ..... 10 2021 132 116.6

(51) Int. Cl.
*B65D 47/08* (2006.01)
*B65D 41/04* (2006.01)
*B65D 51/18* (2006.01)

(52) U.S. Cl.
CPC ..... *B65D 47/0809* (2013.01); *B65D 41/04* (2013.01); *B65D 51/18* (2013.01)

(58) Field of Classification Search
CPC ..... B65D 2401/15; B65D 2401/30; B65D 2401/05; B65D 2401/45; B65D 47/0804;
(Continued)

(56) References Cited

U.S. PATENT DOCUMENTS 2,695,732 A * 11/1954 Tupper ..... A47G 19/24 222/480
3,240,405 A * 3/1966 Abbott ..... B65D 47/0838 222/546
(Continued)

FOREIGN PATENT DOCUMENTS

DE 69605288 T2 7/2000
EP 0590325 B1 4/1998
(Continued)

OTHER PUBLICATIONS

Non-Final Office Action mailed Mar. 26, 2025 in connection with U.S. Appl. No. 18/549,392, filed Sep. 7, 2023, 17 pgs.
(Continued)

*Primary Examiner* — Steven A. Reynolds
*Assistant Examiner* — Prince Pal
(74) *Attorney, Agent, or Firm* — Chiesa Shahinian & Giantomasi PC

(57) ABSTRACT

The invention relates to a container closure including a base portion, a pouring region having a peripheral wall that extends about a reference axis of the container closure, and a cap portion which is connected to the base portion by means of a hinge. The cap portion has a base, a peripheral outer wall which extends axially from the base to a peripheral lower edge of the cap portion, and an anchoring wall which extends outside the outer wall and at a radial distance from said outer wall, and which is connected to the lower
(Continued)

edge of the cap portion by means of a bridge of the cap portion that extends radially outwards from the lower edge of the cap portion.

20 Claims, 14 Drawing Sheets

(58) Field of Classification Search
CPC ..... B65D 47/0838; B65D 47/0809; B65D 47/0861; B65D 47/243; B65D 55/16; B65D 55/024; B65D 55/0827; B65D 2251/105; B65D 41/3428; B65D 41/3447; B65D 2555/025
USPC ..... 220/288, 838; 215/235, 237, 344
See application file for complete search history.

(56) References Cited

U.S. PATENT DOCUMENTS 3,549,053 A * 12/1970 Anderson ..... B65D 47/122 222/541.6
3,603,470 A * 9/1971 Armour ..... B65D 50/045 215/213
4,431,110 A * 2/1984 Roth ..... B65D 47/0838 220/270
4,807,769 A * 2/1989 Gach ..... B65D 47/103 222/541.9
5,065,911 A * 11/1991 Rohr ..... B65D 47/0861 215/238
5,088,612 A * 2/1992 Storar ..... B65D 51/002 215/237
5,427,260 A * 6/1995 Mueller ..... B65D 47/0809 222/541.9
5,501,348 A * 3/1996 Takeuchi ..... B65D 47/0828 220/827
5,540,343 A 7/1996 Schumacher
5,642,824 A 7/1997 Hess, III et al.
5,819,965 A * 10/1998 King ..... B65D 41/3409 215/252
5,875,907 A * 3/1999 Lay ..... B65D 47/0804 215/901
6,269,986 B1 * 8/2001 Gross ..... B65D 47/0804 222/153.06
6,305,563 B1 * 10/2001 Elliott ..... B65D 47/0809 220/837
6,382,476 B1 * 5/2002 Randall ..... B65D 47/0885 220/259.2
6,644,487 B2 * 11/2003 Smith ..... B65D 47/0885 222/541.6
D530,611 S * 10/2006 Nusbaum ..... D9/449
7,735,699 B2 * 6/2010 Brannon ..... B65D 47/0842 220/837
7,832,579 B2 * 11/2010 Lohrman ..... B65D 47/36 215/256
7,900,789 B2 * 3/2011 Johnston ..... B65D 55/022 215/331
7,980,432 B2 * 7/2011 Brannon ..... B65D 47/06 220/837
8,016,159 B2 * 9/2011 Ma ..... B65D 41/3447 426/112
8,113,374 B2 * 2/2012 Steiger ..... B65D 47/0809 220/258.2
8,220,650 B2 * 7/2012 Smith ..... B65D 47/2018 215/311
8,308,022 B2 * 11/2012 Barre ..... B65D 47/0828 220/837
8,393,483 B2 * 3/2013 Druitt ..... B65D 41/04 215/344
8,403,159 B2 * 3/2013 Antier ..... B65D 50/046 215/253
8,439,212 B2 * 5/2013 Clodfelter ..... B65D 47/0857 215/253
8,523,025 B2 * 9/2013 Skillin ..... B65D 47/0809 222/546
8,556,103 B2 * 10/2013 Tiesberger ..... B65D 51/2864 220/254.1
8,579,140 B2 * 11/2013 Delagrange ..... B65D 50/065 215/221
8,646,634 B2 * 2/2014 Essebaggers ..... B65D 51/222 222/541.2
9,045,263 B2 * 6/2015 Fox ..... B65D 43/0285
9,051,090 B2 * 6/2015 Antier ..... B65D 47/08
9,290,973 B2 * 3/2016 Quinn ..... B65D 43/168
9,382,045 B2 * 7/2016 Wohlgenannt ..... B65D 43/0212
9,415,909 B2 * 8/2016 Druitt ..... B65D 47/0809
9,439,523 B2 * 9/2016 Naesje ..... B65D 51/18
9,828,146 B2 * 11/2017 Loukov ..... B65D 41/485
9,884,706 B1 * 2/2018 Skillin ..... B65D 47/32
9,932,158 B2 * 4/2018 Rognard ..... B65D 47/0838
10,214,325 B2 * 2/2019 Rognard ..... B65D 47/0852
10,266,311 B2 * 4/2019 Rognard ..... B65D 41/3457
10,414,557 B2 * 9/2019 Skillin ..... B65D 47/40
10,427,823 B2 * 10/2019 Kim ..... B29B 11/08
10,730,672 B2 * 8/2020 Bertram ..... B65D 51/248
10,926,923 B2 * 2/2021 Berroa Garcia ..... B65D 41/32
10,940,494 B2 * 3/2021 Romanov ..... B05B 11/047
11,220,378 B2 * 1/2022 Garcia Alberola ..... B65D 47/0838
11,292,641 B2 * 4/2022 Mühlemann ..... B65D 47/0838
11,401,078 B2 * 8/2022 Graux ..... B65D 55/16
11,492,179 B2 * 11/2022 Rognard ..... B65D 55/024
11,623,798 B2 * 4/2023 Hiltser ..... B65D 51/24 215/230
11,718,450 B2 * 8/2023 Berroa ..... B65D 41/3428 215/243
11,731,814 B2 * 8/2023 Saito ..... B65D 50/046 215/235
11,753,217 B2 * 9/2023 Berge ..... B65D 47/0842 215/235
11,780,653 B2 * 10/2023 Rognard ..... B65D 41/485 215/235
11,780,659 B2 * 10/2023 Gauxachs ..... B65D 55/16 215/237
11,787,604 B2 * 10/2023 Ferrari ..... B65D 41/16 215/237
11,787,609 B2 * 10/2023 Ferrari ..... B65D 47/0838 222/23
11,993,426 B2 * 5/2024 Koenigseder ..... B65D 55/026
11,993,436 B2 * 5/2024 Erwin ..... B65D 1/0246
12,012,265 B2 * 6/2024 Koenigseder ..... B65D 55/026
12,077,345 B2 * 9/2024 Benoit-Gonin ..... B65D 41/3447
12,214,935 B2 * 2/2025 Falzoni ..... B65D 55/16
12,351,373 B2 * 7/2025 Forrest ..... B65D 50/046
D1,086,872 S * 8/2025 Van Sprundel ..... D9/447
2003/0034323 A1 * 2/2003 Smith ..... B65D 55/024 215/253
2003/0057209 A1 * 3/2003 Seelhofer ..... B65D 47/128 215/235
2003/0089746 A1 * 5/2003 Odet ..... B65D 47/148 215/254
2003/0116879 A1 * 6/2003 Mueller ..... B65D 47/0809 264/294
2004/0238540 A1 * 12/2004 Jackel ..... B65D 47/103 220/849
2005/0061765 A1 * 3/2005 Skillin ..... B65D 47/0809 215/237
2005/0116382 A1 * 6/2005 Nusbaum ..... B65D 47/148 264/328.1
2005/0133475 A1 6/2005 Goto et al.
2005/0173367 A1 * 8/2005 Nusbaum ..... B65D 47/0842 215/253
2005/0173368 A1 * 8/2005 Nusbaum ..... B65D 47/0842 215/253
2005/0205607 A1 * 9/2005 Hierzer ..... B65D 47/0804 222/546
2005/0236442 A1 * 10/2005 Kratzer ..... B65D 47/088 222/566
2005/0279727 A1 * 12/2005 Graswald ..... B65D 47/0804 222/541.6

(56) References Cited

U.S. PATENT DOCUMENTS

2006/0016776 A1* 1/2006 Barre ..... B65D 47/0871 215/237
2007/0095864 A1* 5/2007 Vangeel ..... B65D 47/0871 222/111
2007/0102390 A1* 5/2007 Hoepner ..... B65D 47/0885 222/153.07
2007/0102392 A1* 5/2007 Hoepner ..... B65D 55/024 215/253
2007/0138124 A1* 6/2007 Skillin ..... B65D 47/0828 220/837
2008/0110933 A1* 5/2008 Goncalves ..... B65D 47/2031 222/153.05
2009/0101618 A1* 4/2009 Seelhofer ..... B65D 51/225 215/237
2009/0120936 A1 5/2009 Zauser et al.
2009/0152269 A1* 6/2009 Pucci ..... B65D 55/024 220/254.3
2010/0102022 A1* 4/2010 Kuwahara ..... B65D 47/0838 215/235
2010/0140268 A1* 6/2010 Lohrman ..... B65D 47/103 220/270
2010/0187233 A1* 7/2010 Fraser ..... B65D 41/08 220/288
2010/0264144 A1* 10/2010 Nusbaum ..... B65D 47/0861 220/258.2
2011/0042341 A1* 2/2011 Jackel ..... B65D 47/0838 215/355
2011/0108509 A1* 5/2011 Fontana ..... B65D 55/024 215/228
2013/0043206 A1* 2/2013 Ochoa Laburu ... B65D 47/0814 215/237
2013/0270273 A1* 10/2013 Fox ..... B65D 50/046 220/324
2015/0048113 A1* 2/2015 Brannon ..... B65D 50/046 222/109
2015/0217914 A1* 8/2015 Burgess ..... B65D 51/2857 220/521
2015/0251820 A1* 9/2015 Glaser ..... B65D 41/3447 220/288
2015/0290640 A1* 10/2015 Goettke ..... B01L 3/5021 220/288
2015/0344196 A1* 12/2015 Groubert ..... B65D 55/024 220/315
2015/0375908 A1* 12/2015 Rognard ..... B65D 47/205 215/235
2016/0090210 A1* 3/2016 Vasquez ..... B65D 47/265 220/254.9
2016/0244219 A1* 8/2016 Benoit-Gonin ..... B65D 55/024
2017/0050773 A1* 2/2017 Rognard ..... B65D 41/3428
2017/0240326 A1* 8/2017 Rognard ..... B65D 47/0804
2018/0208374 A1* 7/2018 Cerveny ..... B65D 47/0804
2018/0312305 A1* 11/2018 Rognard ..... B65D 55/024
2019/0119008 A1* 4/2019 Berroa Garcia ..... B65D 41/32
2019/0225389 A1* 7/2019 Gallay ..... B65D 41/3447
2020/0239203 A1* 7/2020 Rognard ..... B65D 47/08
2021/0039841 A1* 2/2021 Pucci ..... B65D 51/248
2021/0070509 A1* 3/2021 Bevan ..... B65D 47/0857
2021/0101722 A1* 4/2021 Migas ..... B65D 41/465
2021/0229873 A1* 7/2021 Berroa García ... B65D 41/3447
2021/0354883 A1* 11/2021 Ferrari ..... B65D 41/485
2022/0002021 A1* 1/2022 Krautkramer ..... B65D 5/748
2022/0017269 A1* 1/2022 Haas ..... B65D 41/325
2022/0153480 A1* 5/2022 Mayer ..... B65D 41/3428
2022/0388733 A1* 12/2022 Koenigseder ..... B65D 55/026
2023/0017736 A1* 1/2023 Holmes ..... B65D 47/0804
2023/0041392 A1* 2/2023 Dangl ..... B65D 41/3428
2023/0137802 A1* 5/2023 Zhou ..... B65D 47/0885 215/235
2023/0249882 A1* 8/2023 Gomez ..... B65D 41/04 215/235
2023/0264865 A1* 8/2023 Krautkramer ..... B65D 41/485 220/835
2024/0025606 A1* 1/2024 Berge ..... B65D 51/18
2024/0043181 A1* 2/2024 Pucci ..... B29D 99/0096
2024/0140659 A1* 5/2024 Nusbaum ..... B65D 51/18
2024/0150093 A1* 5/2024 Nusbaum ..... B65D 55/0827
2025/0042627 A1* 2/2025 Angelozzi ..... B65D 50/046

FOREIGN PATENT DOCUMENTS

EP 1892194 A1 2/2008
EP 2250102 B1 9/2014
EP 3659937 A1 6/2020
GB 2430667 A 4/2007
WO 2008024775 A1 2/2008
WO 2015049066 A1 4/2015

OTHER PUBLICATIONS

International Search Report and Written Opinion mailed Jul. 7, 2022, in connection with International Patent Application No. PCT/EP2022/055744, 11 pgs. (including translation).
International Search Report and Written Opinion mailed Jul. 7, 2022, in connection with International Patent Application No. PCT/EP2022/055746, 13 pgs. (including translation).

* cited by examiner

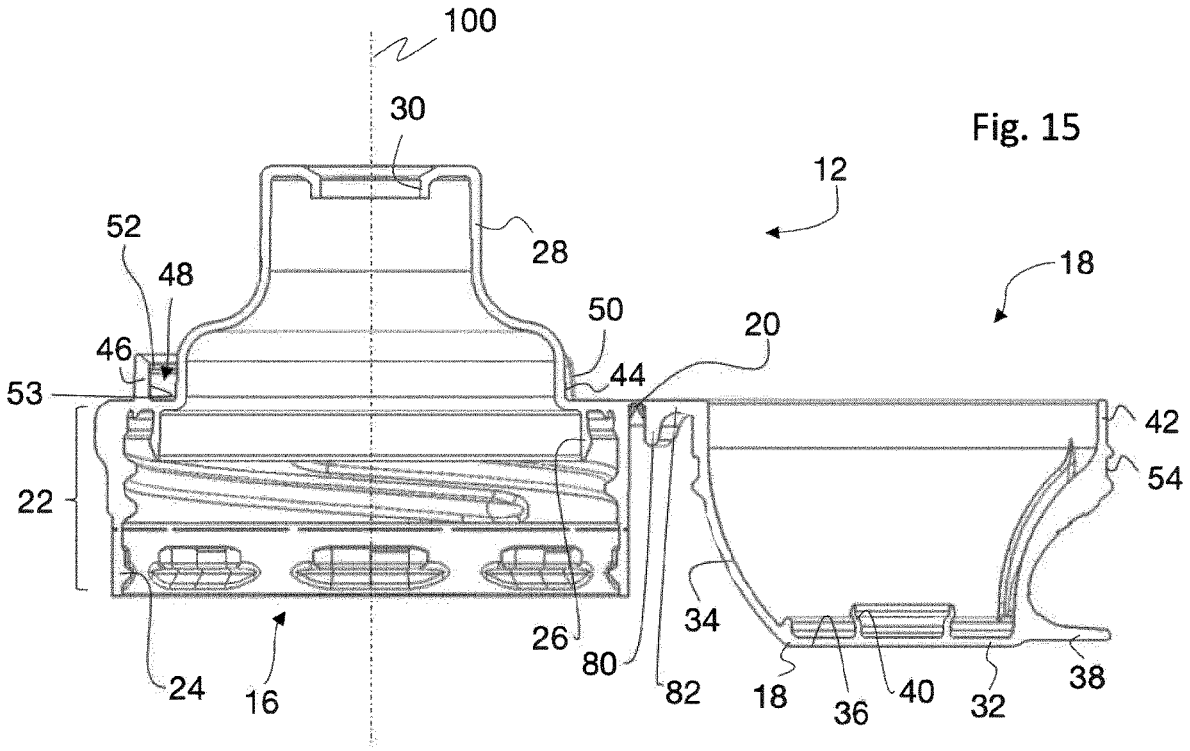
Fig. 15
Fig. 16
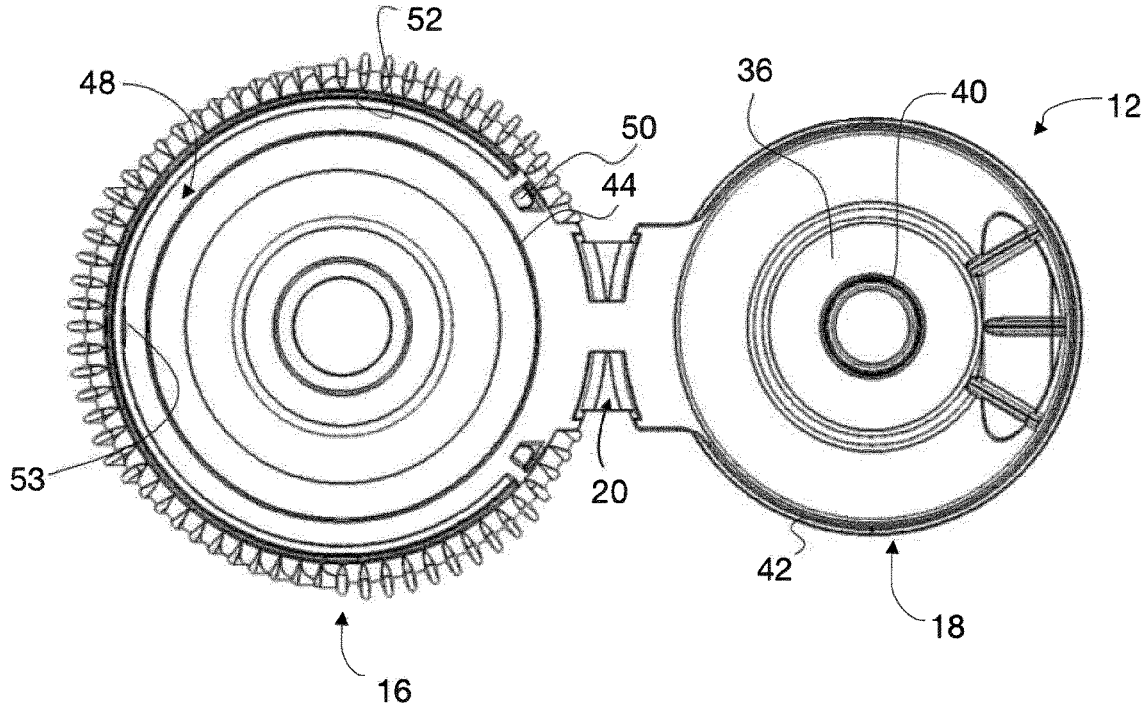

Fig. 17
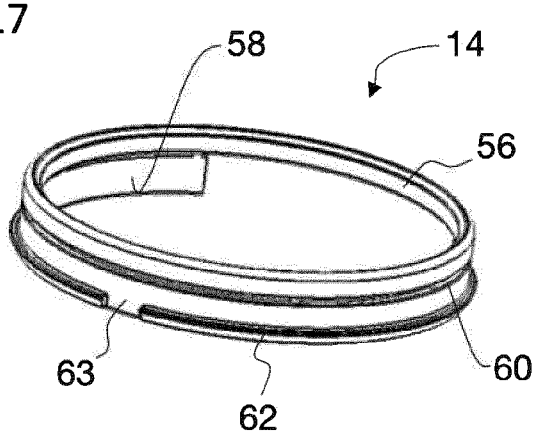
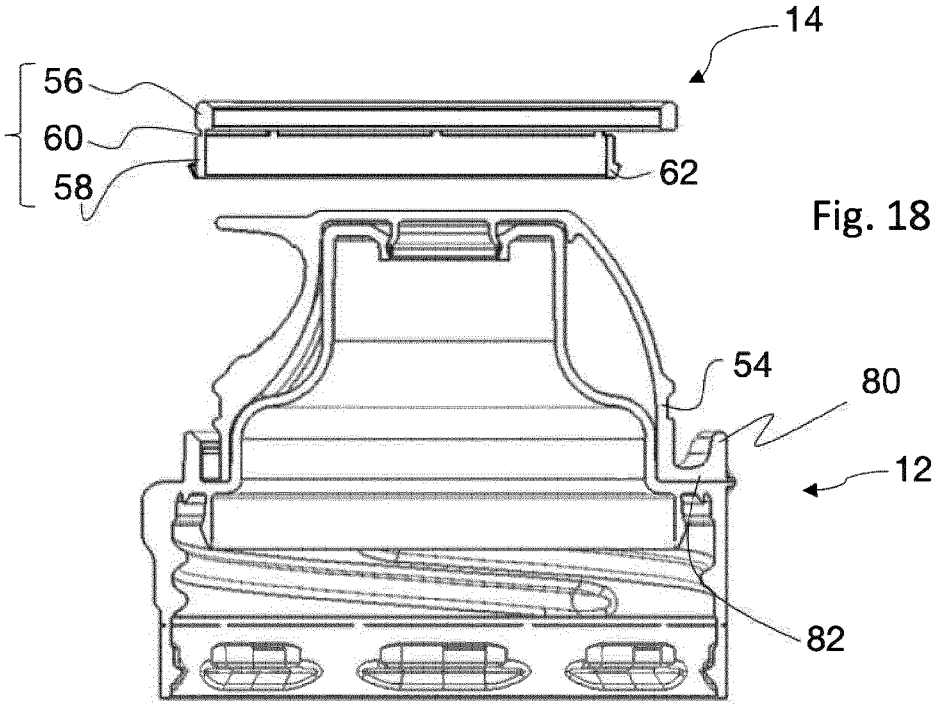
Fig. 18

Fig. 19
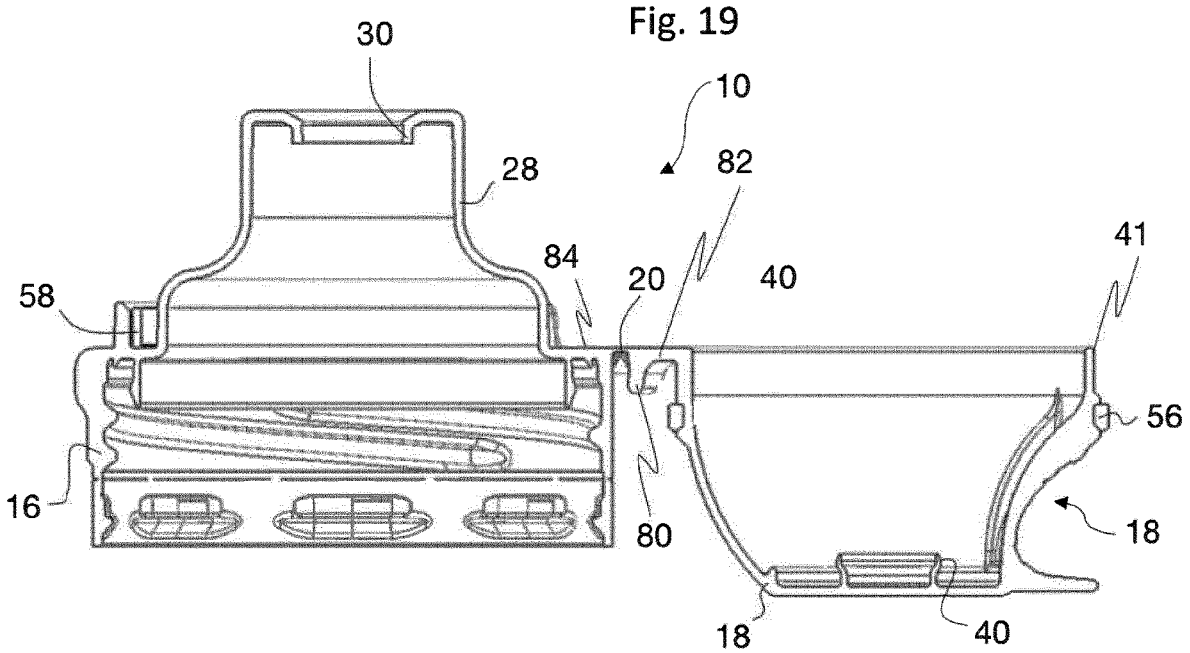
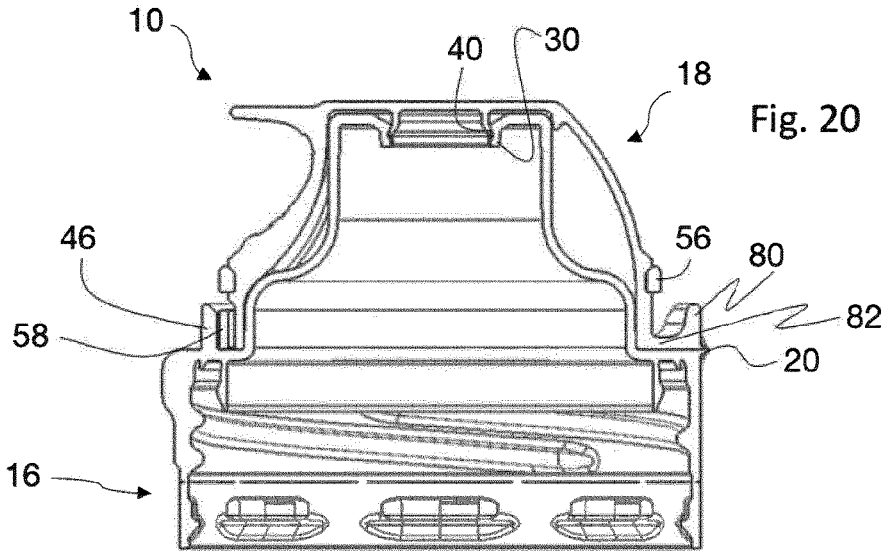
Fig. 20

ASEPTIC CONTAINER CLOSURE HAVING A HINGE AND A MOUTHPIECE

CROSS-REFERENCE TO RELATED APPLICATION(S)

This application is a National Stage under 35 U.S.C. 371 of International Patent Application No. PCT/EP2022/055746, filed Mar. 7, 2022, which claims the benefit of priority under 35 U.S.C. 119 to: (i) German Patent Application No. 102021132116.6, filed Dec. 7, 2021; (ii) German Patent Application No. 102021113872.8, filed May 28, 2021; and (iii) German Patent Application No. 102021105870.8, filed Mar. 10, 2021; the disclosures of all of which are incorporated herein by reference in their entirety.

FIELD OF APPLICATION OF THE INVENTION

The invention relates to a container closure having a base part, a pouring area and a cap part which is connected to the base part by a hinge and can be rotated back and forth between a closed position and an open position about a pivot axis extending perpendicular to the reference axis.

PRIOR ART

From the document DE69605288T2 a container closure of the type mentioned at the beginning is known, in which the drinking part has a circumferential wall which extends around a reference axis of the container closure and extends axially from the base part to a circumferential upper edge of the pouring area which surrounds the drinking opening. The cap part has a base and an outer wall that extends axially from the base to a circumferential bottom edge of the cap part. In the closed position, the drinking part is surrounded and covered by the cap part. In the open position, the cap part lies on a side opposite the drinking part of a first reference plane of the container closure that contains the axis of the hinge and extends parallel to the reference axis. The hinge is designed as a bistable snap hinge and is arranged in a notch in the outer wall of the cap part, which is a leaky location of the closure. To provide aseptic protection of the pouring area, the cap part has an inner skirt extending from the base to an annular sealing collar, wherein in the closed position the inner skirt encloses the drinking part and the sealing collar abuts an annular sealing surface of the base part, while the circumferential lower edge of the cap part faces a shoulder of the base part. However, this configuration creates a non-aseptic annular cavity between the outer wall and the inner skirt, which can be contaminated by the leaky snap hinge and is difficult to rinse off. In addition, the high inner skirt of the cap part takes up volume, which limits the design space for the drinking part. In particular, the distance from the base part to the upper edge of the pouring area and the diameter of this upper edge must be kept small so that the drinking part does not constitute an obstacle during the transition of the cap part between the closed position and the open position. Further, this closure requires a significant amount of plastic material.

With a shorter inner skirt, such as disclosed in GB2430667, the upper edge of the pouring area can be made higher and wider, but the sealing of the pouring area against contamination by the gap between the hinge and the outer wall of the cap part is no longer guaranteed.

From EP2250102B1 a container closure is known which is compatible with an aseptic seal of a drinking part. The closure has a base part, a cap part, and an external hinge arrangement arranged to project radially outwardly from the cap part and the base part of the closure when the closure is in the closed position and connected to each of these parts by a radially extending bridge. This ensures that the interface between the hinge and the cap part does not have any leakage. However, this hinge configuration requires a lot of space in the radial direction. Further, it is sensitive to shock and difficult to install in a filling line.

From EP0590325, a container closure having a base part and a cap part is known, wherein the cap part is connected to the base part by a snap hinge having two side hinge tabs and a center hinge. The hinge tabs abut at their ends against ridges free-standing in a step-shaped recess in the outer wall of the cap part or base part, wherein these ridges can be bent out to prevent overstretching of the hinge tabs. However, the center hinge is attached directly to the outer wall of the cap part, and forms a leaky location, making the closure unsuitable for aseptic use. Furthermore, the pivot axis of the hinge is close to the outer wall, and the leg movement of the cap part that can be achieved with it is unsuitable for a container closure with an axially extending drinking part.

PRESENTATION OF THE INVENTION

The object of the invention is to provide a container closure of the prior art which remedies at least one of the aforementioned disadvantages of the prior art.

In a container closure having a base part, a pouring area having a peripheral wall extending about a reference axis of the container closure and extending axially from the base part to a peripheral top edge of the pouring area surrounding a drinking opening, a cap part connected to the base part by a hinge and rotatable back and forth between a closed position and an open position about a pivot axis extending perpendicular to the reference axis, wherein the cap part has a base and a peripheral outer wall surrounding an inner surface of the base and extending axially from the base to a peripheral lower edge of the cap part, wherein the outer wall and the base of the cap part together surround and cover the pouring area in the closed position, the object is solved in that the cap part has an anchor wall which extends outside the outer wall at a radial distance from the outer wall and is rigidly connected to the lower edge of the cap part by a radially extending bridge of the cap part, wherein in the closed position the anchor wall projects from the bridge in a direction opposite to the base part and the hinge is connected to the anchor wall and extends from the anchor wall towards the base part.

The bridge connecting the anchor wall to the outer wall of the cap part provides separation between the hinge and the outer wall, allowing the outer wall to enclose the pour area without interruption and provide aseptic protection of the pour area. The fact that the anchor wall extends radially outside the outer wall means that the distance of the pivot axis from the reference axis is greater than the distance of the outer wall from the reference axis, thus ensuring sufficient design freedom for the pouring area. The location of the bridge on the lower edge of the outer wall reduces the risk of damage from an impact and simplifies the mounting of the container closure on the container in a filling line. The channel formed by the anchor wall, the bridge and the opposite surface of the outer wall is easy to wash down.

In accordance with a preferred embodiment, the bridge has a planar contact surface that faces a planar surface of the base part in the closed position and preferably contacts the planar surface of the base part. The bridge is protected by the base part.

For a pleasant user experience, the hinge is preferably designed so that, in the open position, the cap part lies on a side opposite the pouring area of an orthoradial reference plane of the container closure that contains the axis of the hinge and extends parallel to the reference axis. In accordance with a preferred embodiment, the hinge is a bistable snap hinge that can preferably be pivoted back and forth through more than 180°. In particular, the hinge can be designed as a film hinge or butterfly hinge.

In the closed position, the hinge may lie partially in a recess in the anchor wall and, if necessary, be protected by the anchor wall surrounded laterally. In accordance with a preferred embodiment, the hinge is connected to a preferably flexible ridge that is free-standing in the cavity of the anchor wall, which avoids over-extension of the hinge.

Similarly, in the closed position, the hinge may be partially located in a recess of the base part and may be laterally surrounded and protected by the base part. In accordance with a preferred embodiment, the hinge is connected to a preferably flexible ridge which is free-standing in the recess of the base part and avoids overstretching of the hinge.

To ensure safe aseptic protection of the pouring area, the outer wall of the cap part may have a circumferential sealing surface which, in the closed position, abuts a circumferential sealing surface of the circumferential wall of the pouring area. One of the two seals can be a seal collar and the other a seal seat. The geometry is preferably such that, in the closed position, a circumferential line of contact between the sealing surfaces has a distance from a cross-sectional plane containing the pivot axis and extending perpendicular to the reference axis that is less than one-third of the distance of the upper edge of the pouring area from the second reference plane. Preferably, the circumferential contact line has a diameter greater than the distance of the upper edge of the pouring area from the cross-sectional plane. Preferably, the circumferential contact line has a distance to an orthoradial reference plane containing the axis of the hinge and extending parallel to the reference axis which is greater than the distance of the circumferential contact line to the cross-sectional plane.

In accordance with a preferred embodiment, the cap part has an inner circumferential centering bead that, in the closed position, surrounds the top edge of the pouring area and contacts the top edge of the pouring area. This prevents lateral impacts from damaging or leaking the closure during transport or bearing of the closed containers. The centering bead may have a circumferential contact surface with the upper edge of the spout area in the closed position, which may help to seal the drinking opening.

To seal the drinking opening, the cap part may have an inner sealing skirt extending axially from the inner surface of the base of the cap part and, in the closed position, coming into contact with an inner annular fold of the peripheral wall of the spout area.

In accordance with one embodiment, the cap part is designed integrally with the hinge and the base part. The pouring area can be designed in one piece with the base part or separated from the base part. In accordance with one variation, the base part has a base piece and an anchor ring that engages in an annular notch of the base piece, wherein the anchor ring is integrally designed with the hinge and the cap part.

The pouring area can be designed in one piece with the base part. Alternatively, the container closure may have a spout separate from the base part forming a spout area and the drinking opening of the container closure, wherein the spout is covered by the cap part in the closed position.

In accordance with a preferred embodiment, the base part has a connection point, particularly a thread, for connection to a container neck. However, other fastening means are conceivable, e.g., a circumferential fixing collar or a series of elastic latching hooks distributed around the circumference of the base part and engaging behind a circumferential retaining collar of the container neck when mounted on the container neck.

The base part can have a sealing collar, preferably directed radially outward, to ensure a tight connection to the container neck.

The cap part has a base that closes the opening of the base part. Preferably, the outer wall of the cap part tapers from the notch to the base.

BRIEF DESCRIPTION OF THE DRAWINGS

Embodiments of the present invention will be described with reference to the accompanying drawings. In the drawings:

FIG. 15: shows a sectional view of an injection molded part of the container closure in accordance with the second embodiment, in an open position immediately after being ejected from the injection mold;

FIG. 16: shows a top view of the injection molded part of FIG. 15;

FIG. 17: shows a perspective view of a guarantee ring of the container closure in accordance with the second embodiment;

FIG. 18: shows a sectional view of the injection molded part of FIG. 16 after it has been placed in the closed position and of the guarantee ring of FIG. 17 before it is placed on the closed injection molded part;

FIG. 19: shows a sectional view of the container closure in accordance with the second embodiment, in the open position after the first opening;

FIG. 20: shows a sectional view of the container closure in accordance with the second embodiment, in the closed position after the first opening;

In all drawings, individual reference numerals denote identical or similar elements.

DETAILED DESCRIPTION OF EMBODIMENTS

Figure 1:
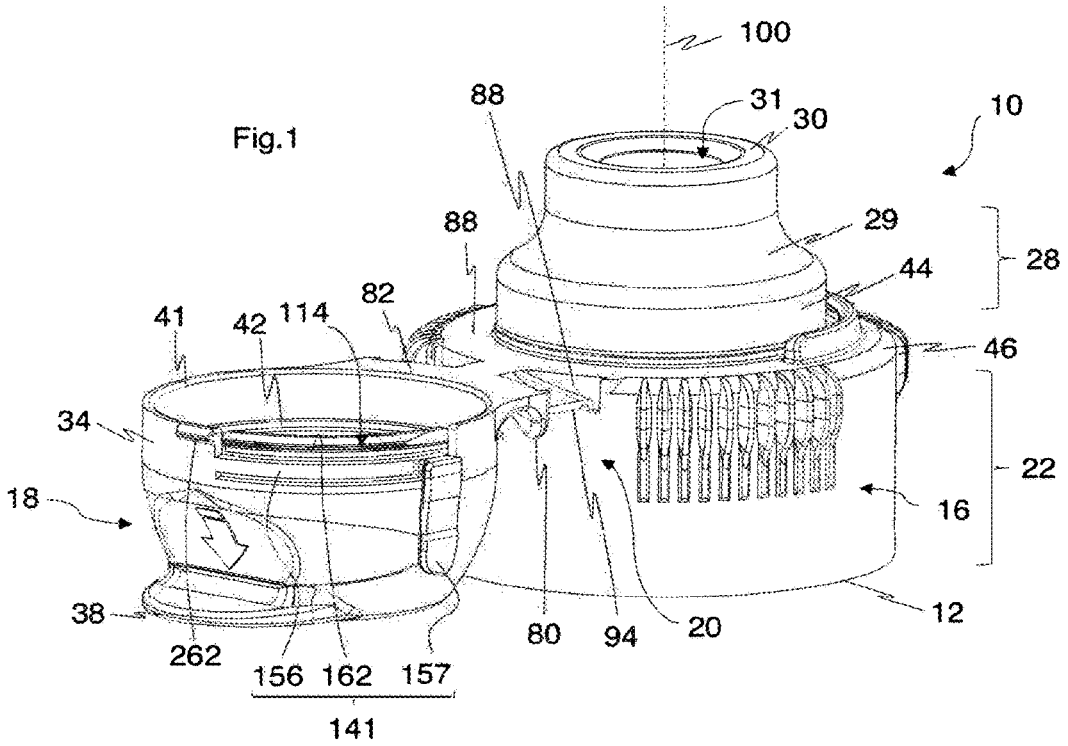
FIG. 1: shows a first perspective view of a container closure in accordance with a first embodiment of the invention in an open position from an injection mold.

With reference to FIGS. 1 to 12, a first preferred embodiment of a container closure of the present invention is indicated by reference numerals 10. The closure 10 is determined to be mounted on the neck of a container.

Figure 2:
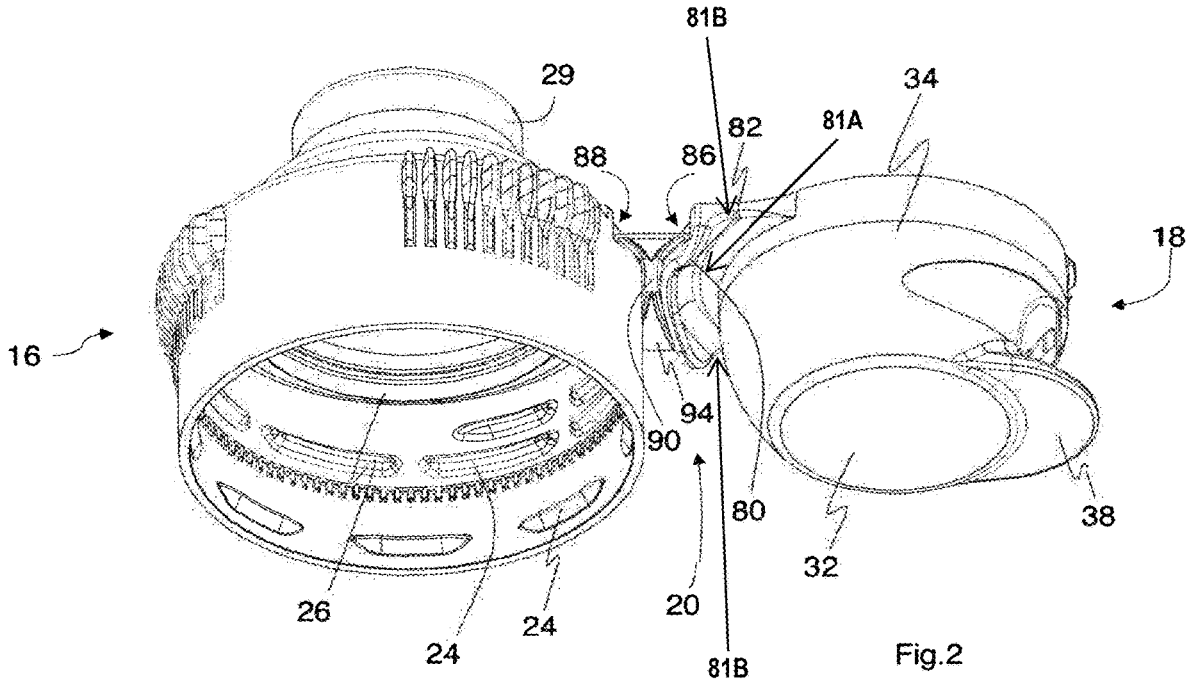
FIG. 2: shows a second perspective view of the container closure in accordance with the first embodiment of the invention in an open position from an injection mold.

In this embodiment, the container closure 10 is produced from a single injection molded piece 12 in an injection mold in an open position in accordance with FIGS. 1 and 2. The container closure 10 may be produced from a plastic or other material that is compatible with the contents of the container. Preferred here is a polymer, particularly a thermoplastic such as polyethylene or polypropylene. In particular, opaque materials such as opaque polypropylene or high-density polyethylene (HDPE) can be used here. Transparent materials are also applicable.

The injection molded piece 12 comprises a base part 16, a cap part 18, and a hinge 20 connecting the cap part 18 to the base part 16. Throughout the description, implicit reference is made to an upward direction corresponding to an orientation in a closed position of the container closure 10 in which a reference axis 100 of the container closure 10 is perpendicular and the cap part 18 is located above the base part 16 (see, for example, FIGS. 4 and 5).

The base part 16 features an attachment area 22 that surrounds the reference axis 100 of the container closure 10, and has fastening protrusions 24, such as a thread, for fastening to the neck of the container. The attachment area 22 may also include a sealing skirt 26, which is determined to engage the interior of the container neck when the container closure 10 is placed on the container neck. The sealing skirt 26 may have a circumferential bead or curvature. Further, the base part 16 has a spout area 28 that projects axially in the direction opposite the attachment area 22. This pouring area 28 has a peripheral wall 29 which extends about the reference axis 100 of the container closure 10 and extends and tapers axially from the attachment area 22 to a peripheral upper edge 30 of the pouring area 28, forming a radially inwardly directed fold at the upper edge of the pouring area 28 which surrounds a drinking opening 31.

The cap part 18 comprises a base 32, an outer wall 34 surrounding an inner wall surface 36 of the base 32, and a gripping projection 38 extending radially outwardly from the outer wall 34.

The base 32 may be flat or curved. Extending from the inner wall surface 36 of the base 32 is an annular sealing skirt 40, which is enclosed by the outer wall 34 at a radial distance. This sealing skirt 40 is determined to engage the interior of the drinking opening 31 of the pouring area 28 when the cap part 18 is in the closed position. The sealing skirt 40 may have a circumferential bead or curvature. At the edge of the base 32, the cap part 18 has an inner circumferential centering bead 41 which, in the closed position, surrounds and externally contacts the upper edge 30 of the spout area 28. Where appropriate, the centering bead 41 may have a circumferential contact surface with the upper edge 30 of the spout area 28.

The outer wall 34 has a free peripheral lower edge 41 which extends in a plane about the reference axis 100 of the container closure 10 over an angle of preferably more than 180°, in the example more than 260°, and bounds an approximately rectangular recess 141 over the remaining angle of preferably more than 30°, in the example more than 90°. This recess 141 houses an indicator part 114, which has a pull tab 156 and a hook area 162, shown in detail on FIG. 6. The hook area 162, which projects radially outward, is located on a lower side of the pull tab 156 and is and connected to the pull tab 156 by a breakaway line 160 or frangible ridges. The pull tab 156 and hook area 162 extend circumferentially across the entire width of the recess to occupy the entire recess. At one end, the pull tab 156 is fixedly connected to a lateral edge of the recess 141, while the free opposite end 157 of the pull tab 156 extends out of the recess 141 so that it can be grasped and pulled by a user. Where appropriate, the pull tab 156 is connected to an upper edge of the recess 141 by a breakaway line 260 or frangible ridges. The lower edge 41 of the outer wall may further have a protrusion 262 that is immediately adjacent to the recess 141 and projects outwardly.

On the inside, the outer wall 34 has an annular lower sealing bead 42 which is located axially at a certain distance from the recess 141 and, in the closed position of the closure piece 12, rests radially against an, for example, cylindrical or slightly conical, radially outwardly directed seating surface 44 of the in a connection area between the pouring area 28 and the attachment area 22 of the base part 14. Thus, in the closed position, the cap part 18 encloses the pouring area 28. The sealing bead 42 and sealing skirt 40 allow liquid and gas tight sealing of the space enclosed by the cap part 18 and base part 14. This is advantageous for the use of the closure for aseptic filling. If necessary, the sealing bead may be present on the spout part and the seating surface on the cap part.

The seating surface 44 is partially enclosed by a curved hook wall 46 which projects axially from the attachment area 22 and extends through an angle preferably greater than 30°, in the example greater than 90° about the reference axis 100 of the container closure 10. The seating surface 44 and the hook wall 46 are radially spaced apart and define an arcuate cavity 48 into which the hook area of the indicator part 58 intrudes in the closed position, as does the protrusion. The hook wall 46 has a radially inwardly projecting shoulder 52 below which the hook area 162 of the indicator part 58 and the protrusion 262 engage.

The cap part 18 further has an anchor wall 80 extending radially outwardly from the outer wall 34 and rigidly connected to the lower edge 41 of the cap part 18 by a bridge 82 of the cap part 18 extending radially outwardly from the lower edge 41 of the cap part 18. In the closed position, the anchor wall projects from the bridge 82 in an axial direction opposite to the attachment area 22, while the bridge 82 itself faces a flat surface 84 of the base part 16 and preferably comes into contact with the flat surface 84 of the base part 16. The anchor wall 80 is used for fastening the hinge 20 to the cap part 18, and for this purpose has a recess 86 in which a part of the hinge 20 is accommodated. In the closed position, this recess 86 is axially opposite a recess 88 of the base part, which also houses a part of the hinge 20. As previously mentioned, the bridge 82 connecting the anchor wall 80 to the outer wall 34 of the cap part 18 provides separation between the hinge 20 and the outer wall 34, allowing the outer wall 34 to enclose the pouring area 28 without interruption and provide aseptic protection of the pouring area. By having the anchor wall 80 extend radially outwardly from the outer wall 34, it is further achieved that the distance of the pivot axis 200 from the reference axis 100 is greater than the distance of the outer wall 34 from the reference axis 100, thereby providing sufficient design clearance for the pouring area 28. The location of the bridge 80 at the lower edge 41 of the outer wall 34 reduces the risk of damage from an impact and simplifies the mounting of the container closure 10 on a container in a filling line. The channel 81A, having two channel ends 81B, formed by the anchor wall 80, the bridge 82 and the opposite surface of the outer wall 34 can be easily washed away.

The hinge 20 is preferably a snap hinge and allows the cap part 18 to pivot about a pivot axis 200 extending perpendicular to the reference axis of the container closure between a stable closed position and a stable open position. As shown particularly with reference to FIG. 9, the snap hinge 20 may have a central hinge tab 90 located between two parallel lateral hinge tabs 92, wherein the three hinge tabs 90, 92, 92 extend between the base part 16 and the cap part 18. The center hinge tab 90 has a single fold line extending along the pivot axis 200. The two side hinge tabs 92 each have a trapezoidal center portion 94, which is located by oblique fold lines with a ridge 98 freestanding in the recess of the base part 88 and with a ridge 86 freestanding in the recess 86 of the anchor wall 80. The fold lines are thins with a much smaller thickness than the other locations of the hinge tabs 90, 92. The free-standing ridges 96, 98 are preferably elastically deformable.

The snap hinge 20 preferably pivots back and forth through more than 180° so that, in the open position, the cap part 18 lies on a side opposite the pouring area of an orthoradial reference plane 300 of the container closure which contains the pivot axis 200 of the hinge 20 and extends parallel to the reference axis 100.

In the closed position, characteristic dimensions of the container closure 10 can be observed. A circumferential line of contact between the sealing bead 42 and the seating surface 44 has a distance from a cross-sectional plane 400 containing the pivot axis 200 and extending perpendicular to the reference axis 100 that is less than one-third of the distance from the upper edge 30 of the pouring area to said cross-sectional plane 400. The circumferential line of contact has a diameter greater than the distance of the upper edge 400 of the pouring area 28 from the cross-sectional plane 400. The circumferential contact line has a distance to the orthoradial reference plane 300 that is greater than the distance of the circumferential contact line to the cross-sectional plane 400.

Figure 3:
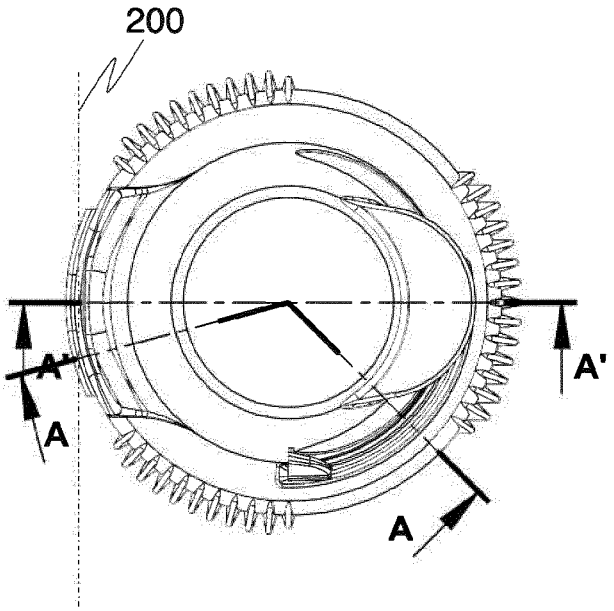
FIG. 3: shows a top view of the container closure in accordance with the first embodiment of the invention in a closed position in front of the first opening.
Figure 4:
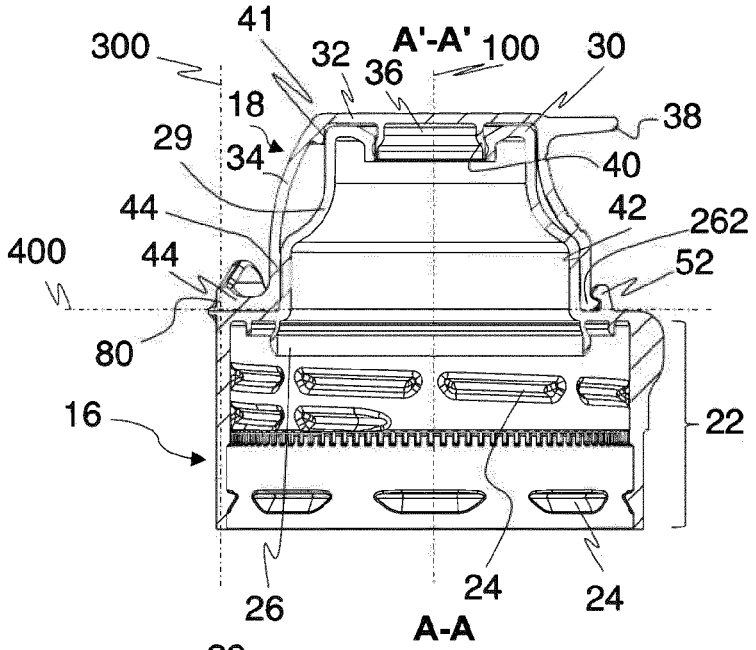
FIG. 4: shows a sectional view through the sectional planes A'-A' of FIG. 3.
Figure 5:
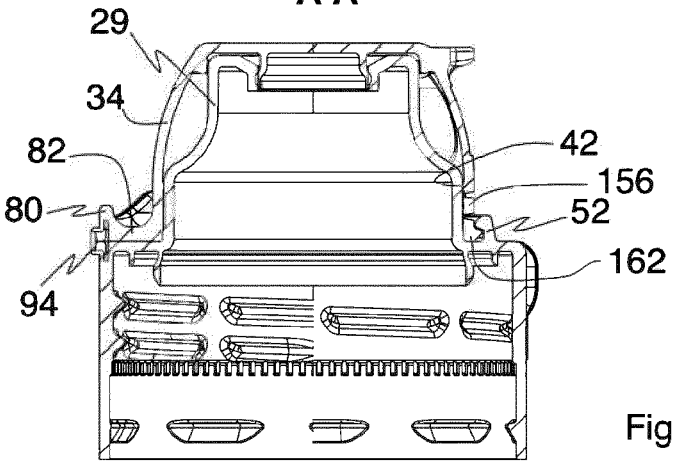
FIG. 5: shows a sectional view through the sectional planes A-A of FIG. 3.
Figure 6:
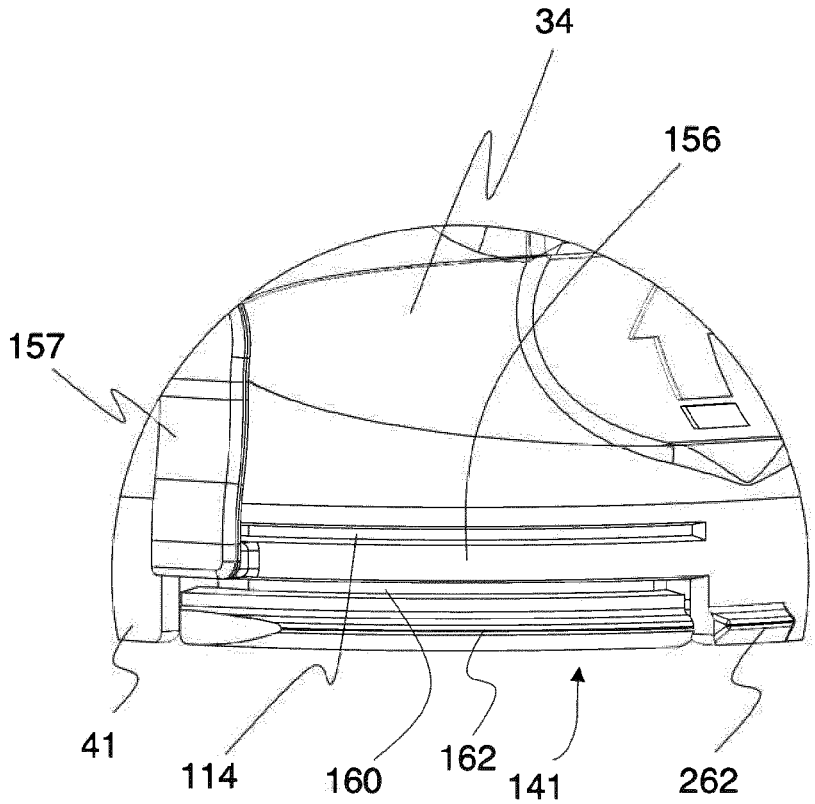
FIG. 6: shows a detailed view of an indicator part of the container closure in accordance with the first embodiment of the invention in the open position from the injection mold.
Figure 7:
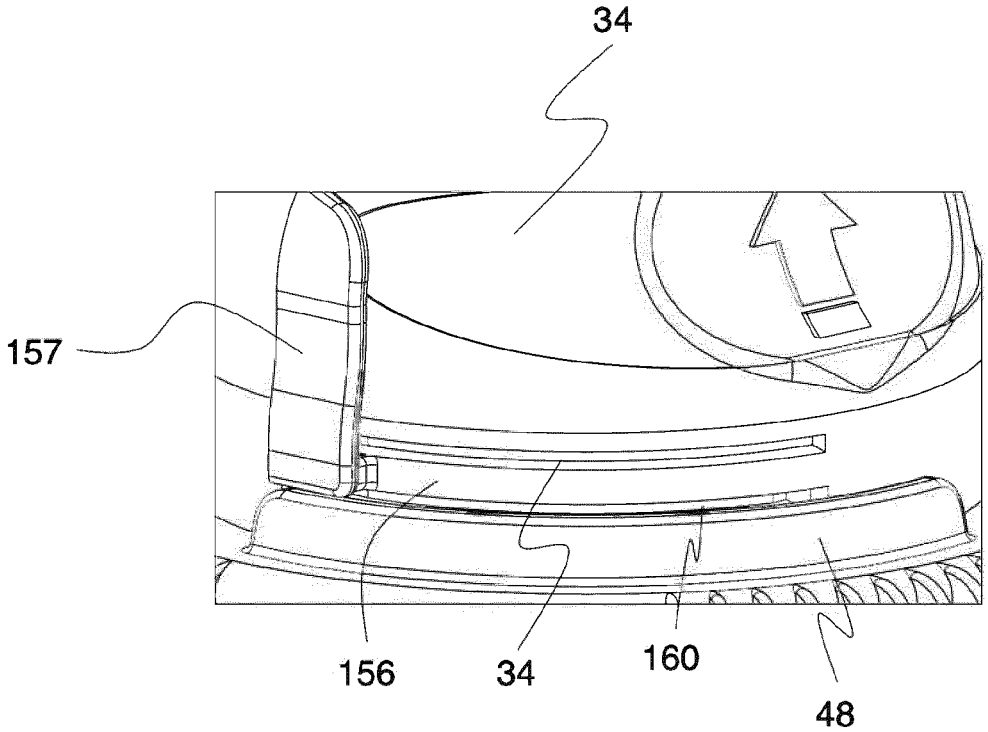
FIG. 7: shows a detailed view of the indicator part of the container closure in accordance with the first embodiment of the invention in a closed position.

The container closure 10 is produced by an injection molding method in the open position of FIGS. 1 and 2, and is then moved to the closed position of FIGS. 3 to 5 in an assembly step, wherein the hook area 162 of the indicator part 114 and the protrusion 262 penetrate under the shoulder 52 by elastic deformation to form a positive connection. The bridge 82 connecting the anchor wall 80 to the outer wall 34 of the cap part 18 provides separation between the hinge 20 and the outer wall 34, allowing the outer wall 34 to enclose the pouring area 28 without interruption and provide aseptic protection of the pouring area 28.

Figure 8:
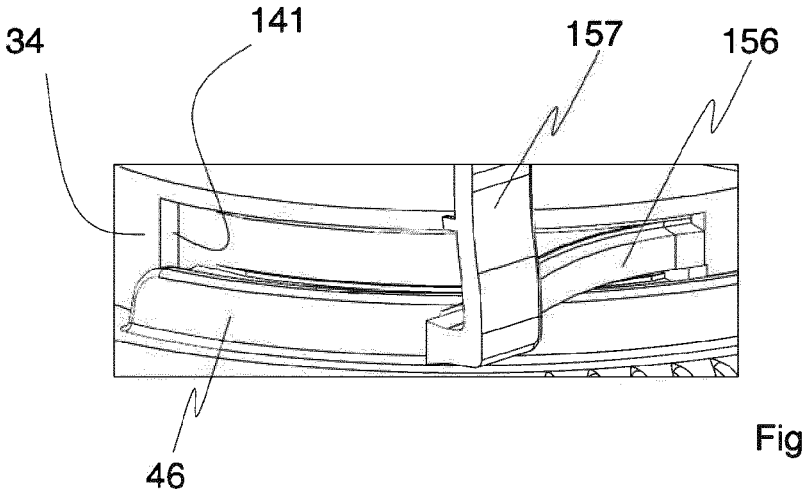
FIG. 8: shows a detailed view of the indicator part of the container closure in accordance with the first embodiment of the invention during the first opening.
Figure 9:
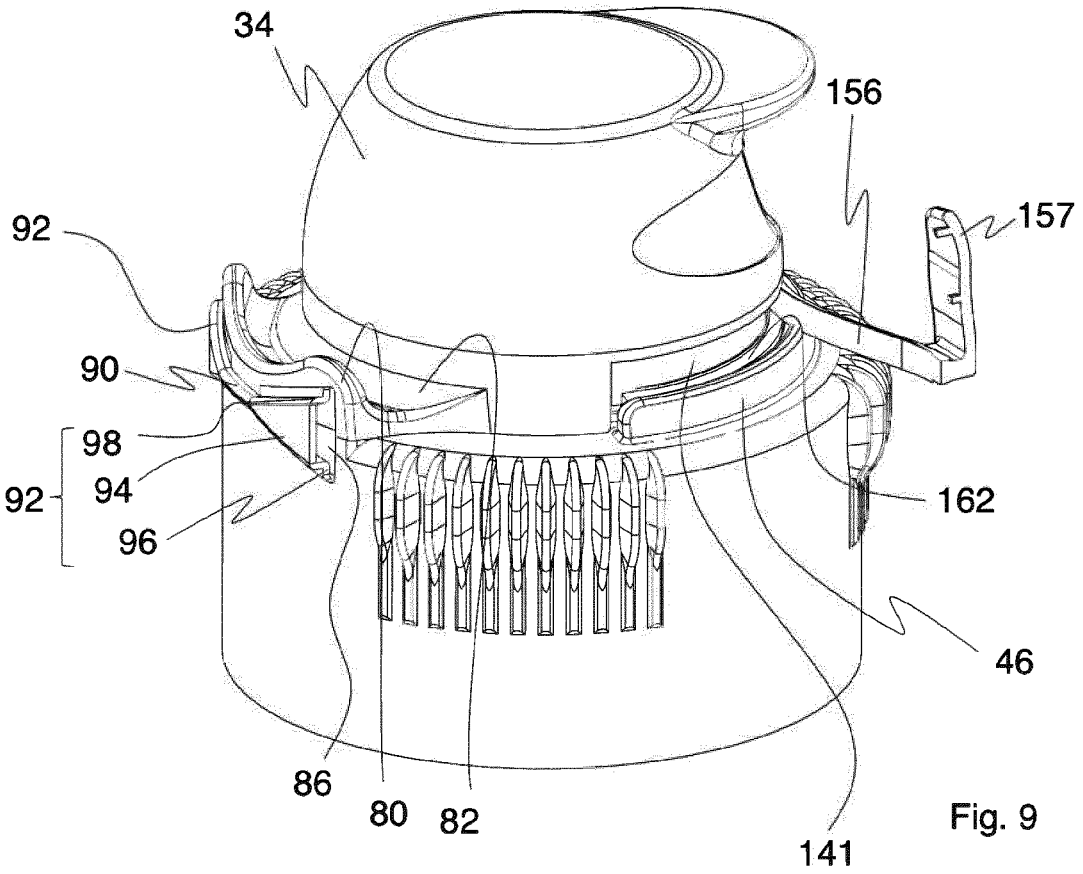
FIG. 9: shows a perspective view of the container closure in accordance with the first embodiment of the invention during the first opening.
Figure 10:
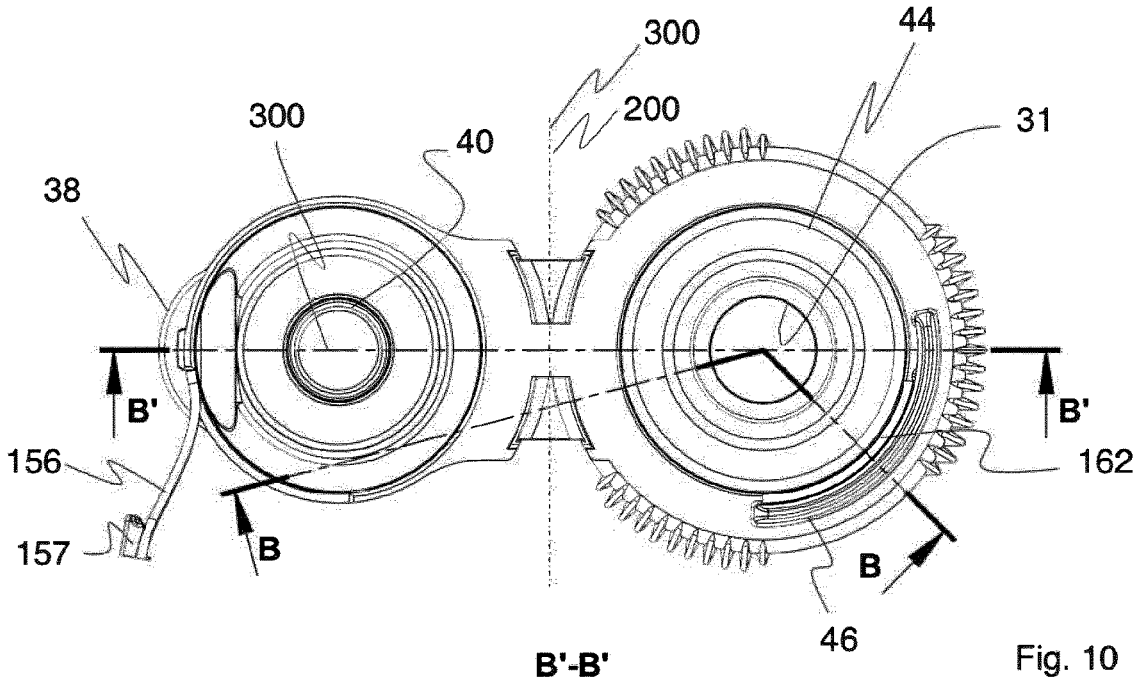
FIG. 10: shows a top view of the container closure in accordance with the first embodiment of the invention in an open position after the first opening.
Figure 11:
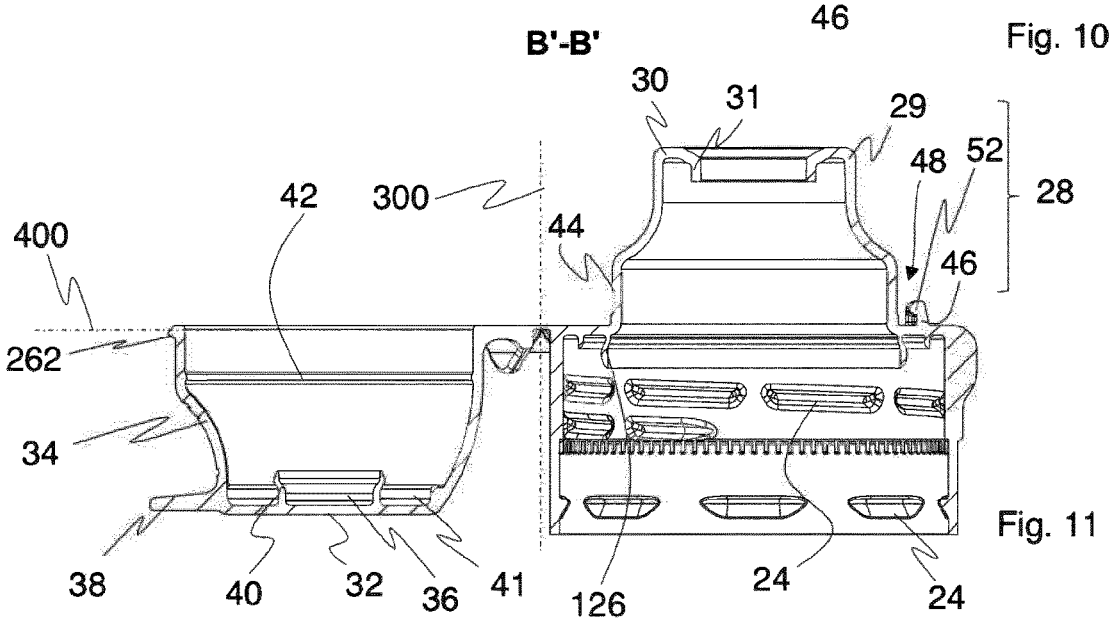
FIG. 11: shows a sectional view through the sectional planes B'-B' of FIG. 10.
Figure 12:
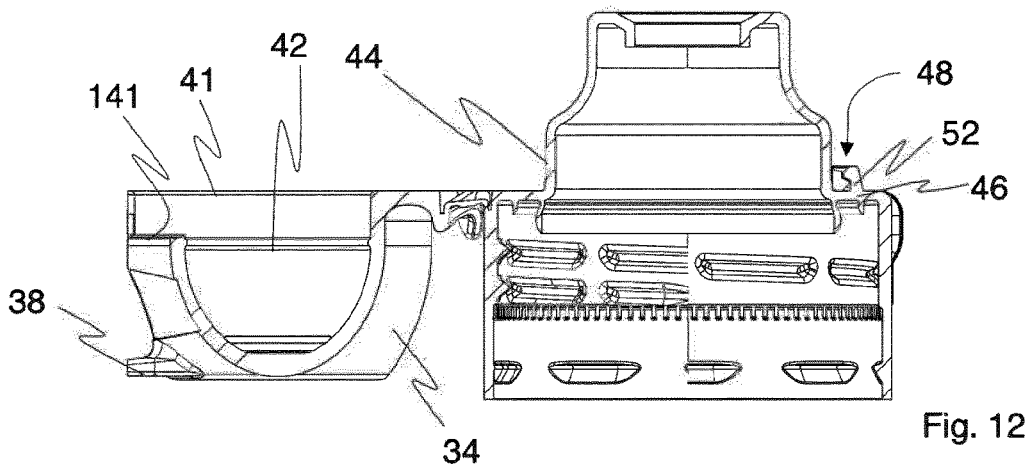
FIG. 12: shows a sectional view through the sectional plane B-B of FIG. 10.

To open the container closure 10, the user pulls the pull tab 156, see FIG. 8 and FIG. 9, so that the tear-off lines 260, 160 or frangible ridges are separated between the pull tab 156 and the hook area 162 on the one hand, and between the pull tab 156 and the upper edge of the recess 141 on the other hand, see FIG. 8. The pull tab 156 remains fixedly connected to the outer wall of the cap part at the end, while the separated hook area 162 remains trapped in the arcuate space 48 between the hook wall 46 and the outer wall 34. A slight pulling force on the gripping projection 38 overcomes the resistance between the latching projection 262 and the shoulder 52, and moves the cap part 18 to the open position, as shown on FIGS. 10 through 12. When the cap part 18 is returned to the closed position after the first opening, the pull tab remains in its deformed position as shown on FIG. 9.

In common with the first embodiment, all further embodiments have a hinge 20 connected to an anchor wall 80 separate from an outer wall 34, the anchor wall 80 being fixedly connected to the lower edge of the outer wall by a bridge 82. The embodiments differ mainly in the indicator device, in the number of injection molded parts that make up the container closure, and in the distribution of the various functions between these parts. To avoid repetition, the following description focuses on the differences, wherein the common features described in the first embodiment are not necessarily repeated.

With reference to FIGS. 13 to 20, a second preferred embodiment of a container closure of the present invention is indicated by reference numerals 10.

In this embodiment, the container closure 10 is composed of two separate injection molded parts, namely a closure piece 12 and a guarantee ring 14. The closure piece 12 may be produced from a plastic or other material that is compatible with the contents of the container. Preferred here is a polymer, particularly a thermoplastic such as polyethylene or polypropylene. In particular, opaque materials such as opaque polypropylene or high-density polyethylene (HDPE) can be used here. The guarantee ring 14 can be produced from a plastic, particularly an opaque plastic, preferably with a color that provides a desirable color contrast with the closure piece.

The closure piece 12, shown individually in FIGS. 15 and 16, comprises a base part 16, a cap part 18, and a hinge 20 connecting the base part 16 to the cap part 18. The hinge 20 is shown here as a snap hinge and allows the cap portion 18 to pivot about a pivot axis that extends perpendicular to the sectional plane of FIG. 13. Other types of hinges are also applicable. The base part 16, the cap part 18 and the hinge 20 are molded together in one part in the open position, as shown in FIGS. 15 and 16.

The base part 16 has an attachment area 22 that surrounds a reference axis 100 of the container closure 10, and means for fastening to the container neck, in this embodiment a thread 24. A sealing skirt 26 is also provided in the attachment area and is determined to engage the interior of the container neck when the container closure 10 is in place on the container neck. The sealing skirt 26 may have a circumferential bead or curvature. In this embodiment, the base part 16 further has a spout area 28 that projects axially in the direction opposite the attachment area, and surrounds a drinking opening 31.

The cap part 18 comprises a base 32, an outer wall 34 surrounding an inner wall surface 36 of the base 32, and a gripping projection 38 extending radially outwardly from the outer wall 34.

The base 32 may be flat or curved. Extending from the inner wall surface 36 of the base 32 is an annular sealing skirt 40, which is enclosed by the outer wall 34 at a radial distance. This sealing skirt 40 is determined to engage the interior of the drinking opening 31 of the pouring area 28 when the cap part 18 is in the closed position. The sealing skirt 40 may have a circumferential bead or curvature.

The outer wall 34 has a lower cylindrical or slightly tapered edge area 42 that, in the closed position of the closure 12, radially abuts a cylindrical or slightly tapered radially outwardly directed seating surface 44 in a connection area between the spout area 28 and the attachment area 22 of the base part 14. Thus, in the closed position, the cap part 18 encloses the pouring area 28. The edge area 42 and the sealing skirt 40 may allow liquid and gas tight sealing of the space enclosed by the cap part 18 and base part 14. This is advantageous for the use of the closure for aseptic filling.

The seating surface 44 is partially enclosed by a curved peripheral wall 46 which projects axially from the attachment area 22 in the direction opposite the thread 24 and extends through an angle preferably greater than 90°, in the example greater than 180° about the reference axis 100 of the container closure 10. The seating surface 44 and the peripheral wall 46 are radially spaced apart and define an arcuate cavity 48 into which the lower edge area 42 of the outer wall 34 of the cap part 18 enters in the closed position. The arcuate cavity 48 is bounded circumferentially by two stops 50, as shown in FIG. 16. The peripheral wall 46 has a radially inwardly projecting shoulder 52, which has a central interruption 53 such that it is visible in the sectional plane of FIG. 14 but not in the sectional plane of FIG. 13.

The outer wall 34 of the cap part 18 has a radially outwardly directed annular notch 54, which is preferably located in a central area of the cap part 18 axially between the base 32 and the lower edge area 42 and which, in the closed position, is not covered by the curved peripheral wall 46 of the base part 16.

The guarantee ring 14 shown in FIGS. 17 and 18 has an annular closed bead 56 projecting inward in the radial direction, an arcuate indicator part 58, and a fracture 60 located between the bead 56 and the indicator part 58. The break point 60 may preferably have frangible ridges or a breakaway line, or optionally a breakaway band. The indicator part 58 has a radially outwardly projecting hook area 62 with a central interruption 63.

As in the first embodiment, the cap part 18 has an anchor wall 80 that extends outside the outer wall 34 at a radial distance from the outer wall 34 and is rigidly connected to the lower edge 41 of the cap part 18 by a bridge 82 of the cap part 18 extending radially outward from the lower edge 41 of the cap part 18.

Figure 13:
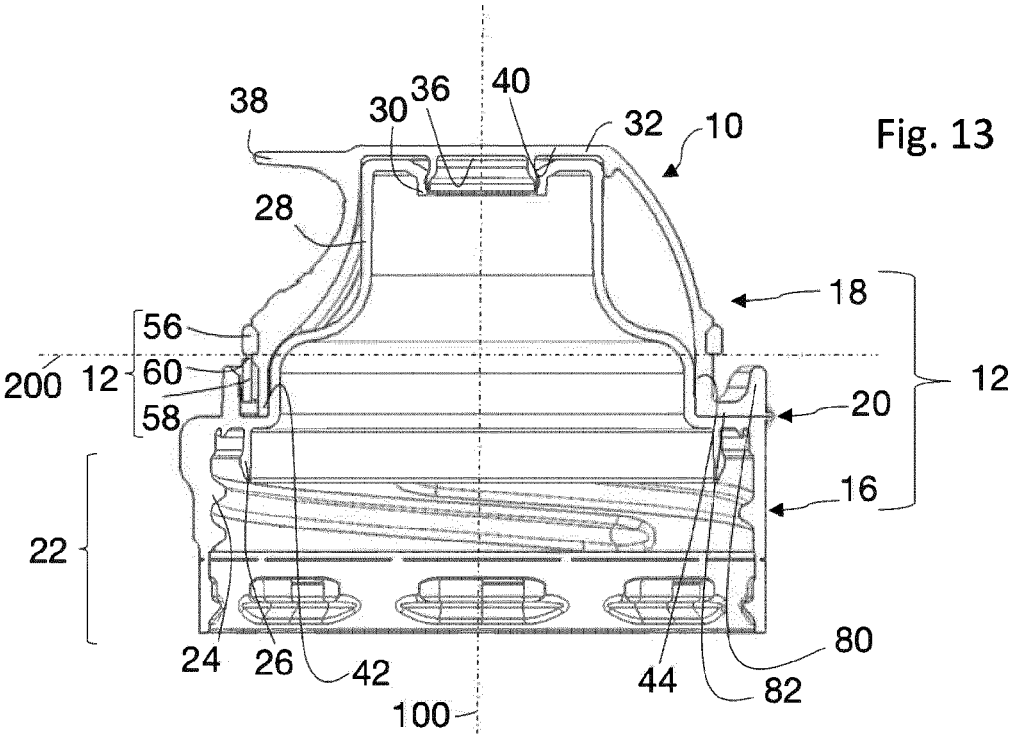
FIG. 13: shows a sectional view of a container closure in accordance with a further embodiment of the invention in a closed position in front of the first opening.
Figure 14:
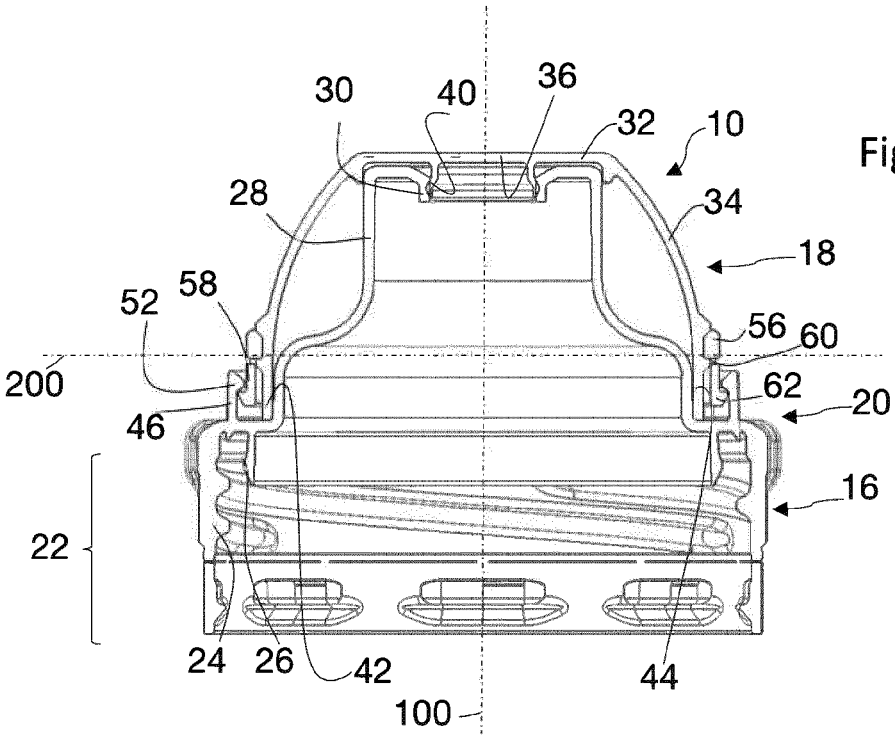
FIG. 14: shows a sectional view of the container closure in accordance with the further embodiment in the closed position in front of the first opening, through a second longitudinal sectional plane extending transversely to the sectional plane of FIG. 13.

The container closure 10 is produced as follows. The closure piece 12 is produced by an injection molding method in the open position of FIGS. 15 and 16, and is brought into the closed position of FIG. 18 in a first assembly step. In a second assembly step, the guarantee ring 14 is placed on the cap part 18 by elastic deformation until the annular bead 56 enters the annular notch 54 and produces a form closure connection with the cap part 18, while the indicator part 58 partially enters the cavity 48 and the hook area 62 engages behind the shoulder 52 of the peripheral wall 46 of the base part 16, as shown in FIGS. 13 and 14. The center interruption 63 of the indicator part 58 coincides with the center interruption 53 of the shoulder 52 to precisely index the position of the indicator part in the circumferential direction. In accordance with one embodiment, the interruptions 53, 63 may be omitted, if necessary.

The indicator part 58 is partially located in an upper area of the cavity 48, radially between the peripheral wall 46 and the lower edge area 42 of the cap part 18, and circumferentially between the stops 50, and projects axially out of the cavity 48 such as to remain partially radially visible in front of the first opening. The hinge 20 and the indicator part 58 are on the same side of a transverse plane 500 that extends through the annular collar 56.

When the container closure 10 is first moved from the closed position of FIGS. 13 and 14 to the open position of FIG. 19, the indicator part 58 is held by the shoulder 52 and the collar 56 is held by the notch 54. The fracture point 60 breaks while the collar 56 remains in the notch 54 and the indicator part 58 falls into the lower area of the cavity 48 due to gravity.

When the container closure 10 is returned to the closed position of FIG. 20 after the first opening, the indicator part 58 remains in the lower area of the cavity 48 where it is entirely covered by the hook wall 46 of the base part 16. This ensures a non-reversible and visible change to the container closure 10. The indicator part 58 remains trapped within the cavity 48.

Figure 21:
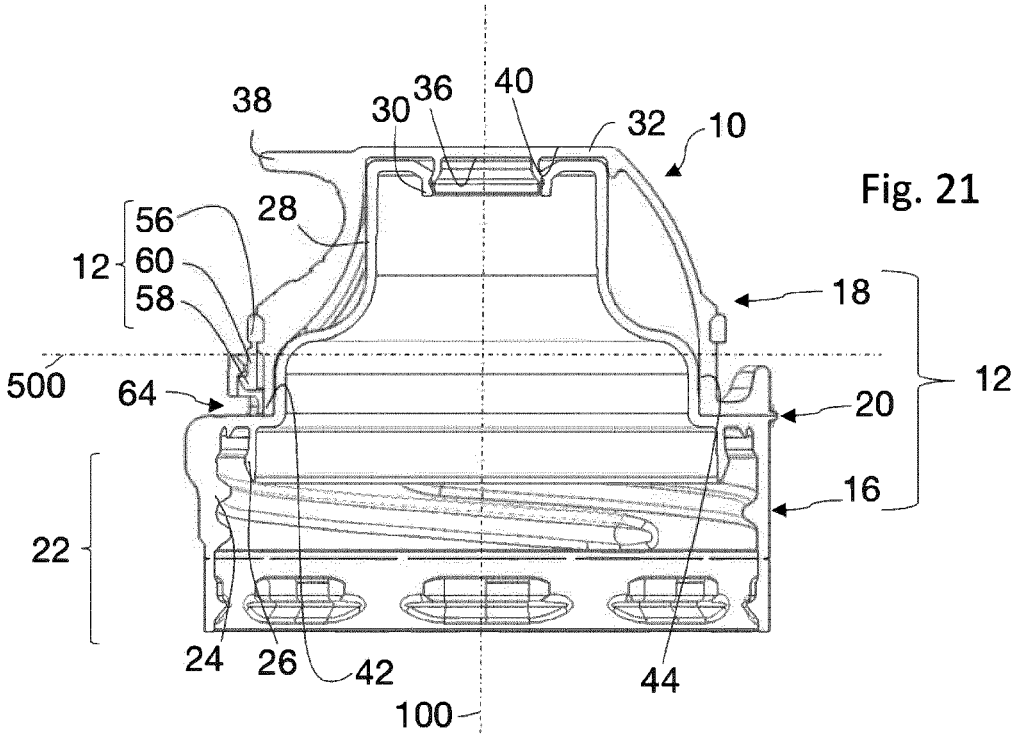
FIG. 21: shows a sectional view of a container closure in accordance with a third embodiment of the invention in a closed position in front of the first opening.
Figure 22:
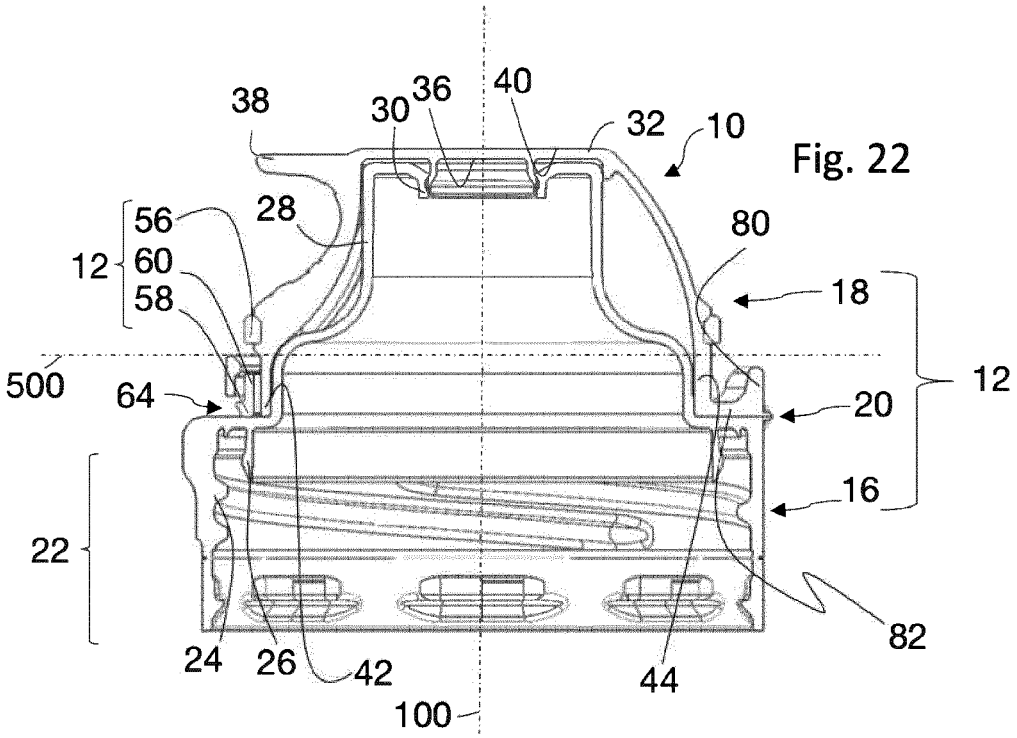
FIG. 22: shows a sectional view of a container closure in accordance with the third embodiment of the invention in a closed position after the first opening.

The container closure 10 in accordance with the third embodiment is shown in FIGS. 21 and 22, and differs from the second embodiment only in that the hook wall 46 of the base part 16, which delimits the cavity 48 radially outwardly, has a window 64 in the lower area through which the indicator part 58 is visible after it has fallen into the lower area of the cavity 48 after the first opening. In this embodiment, the hook area 62 of the indicator part 58 has no interruption and engages behind a shoulder 52 of the hook wall 46, which also has no central interruption.

Figure 23:
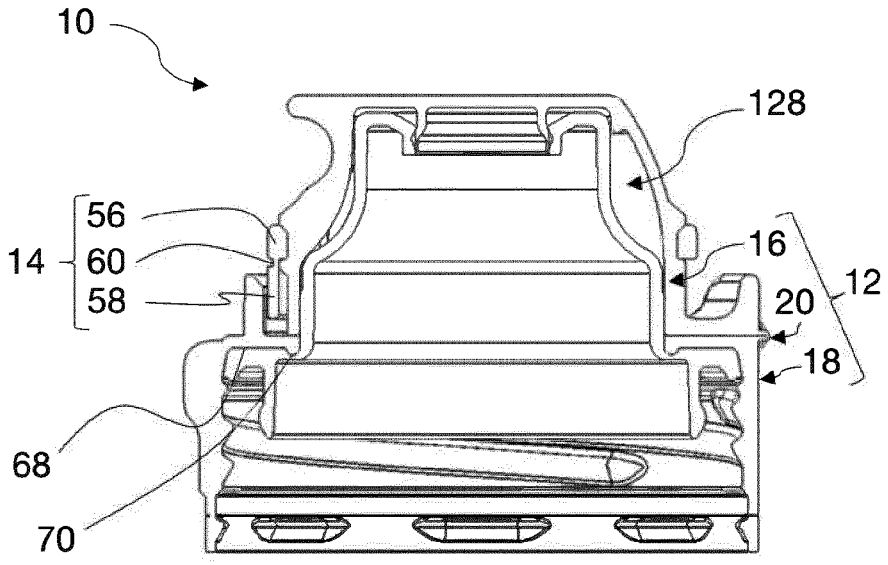
FIG. 23: shows a sectional view of a container closure in accordance with a fourth embodiment of the invention in a closed position in front of the first opening.
Figure 24:
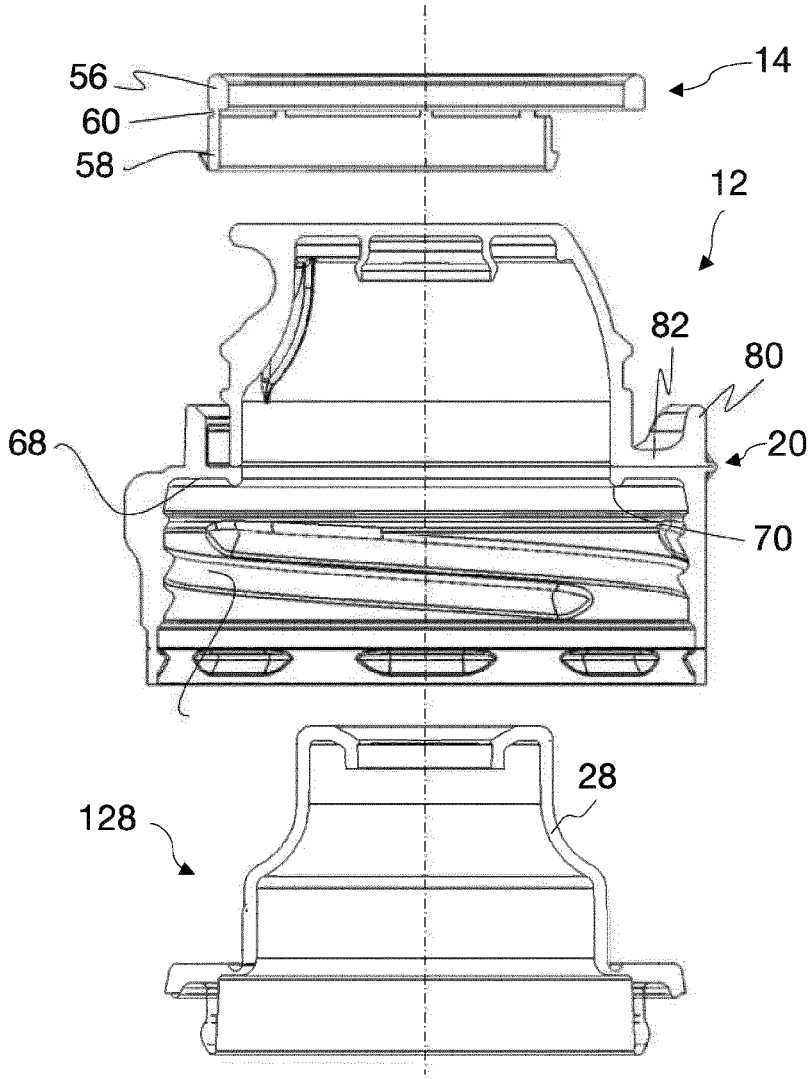
FIG. 24: shows a sectional view of the individual injection molded parts that together form the container closure in accordance with the third embodiment, before they are assembled.
Figure 25:
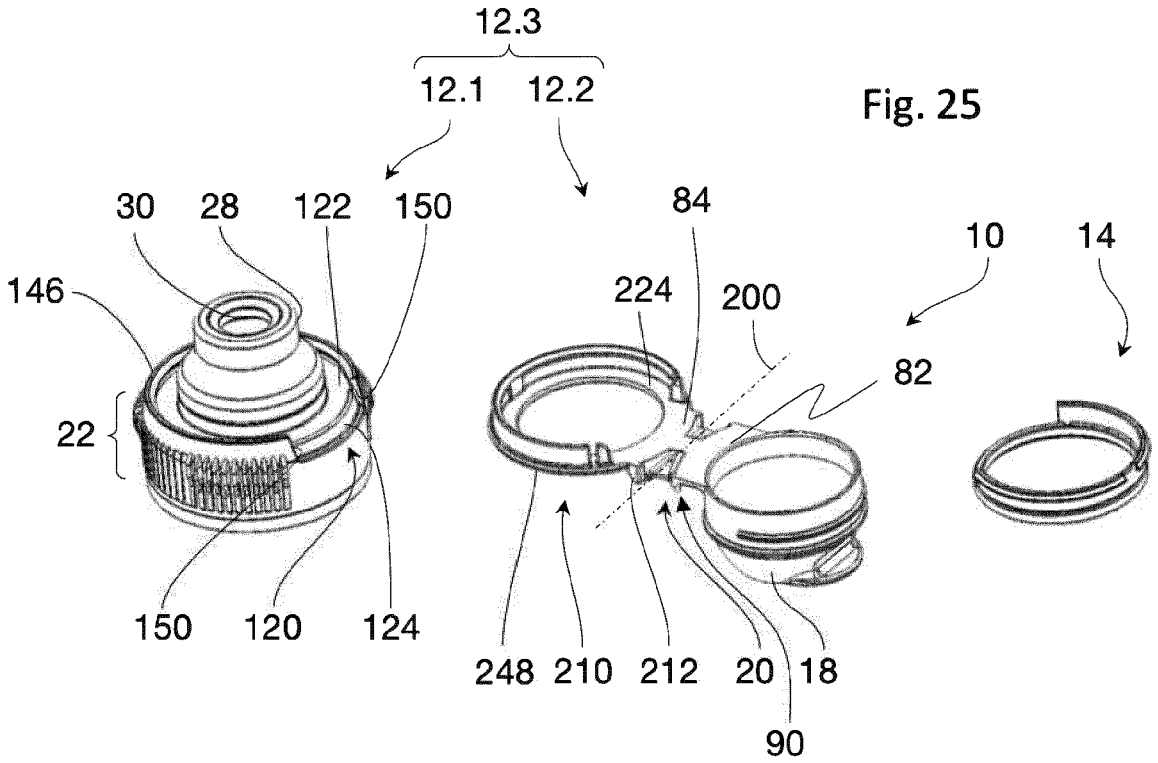
FIG. 25: shows a perspective view of the three parts of a container closure in accordance with a fifth embodiment of the invention.
Figure 26:
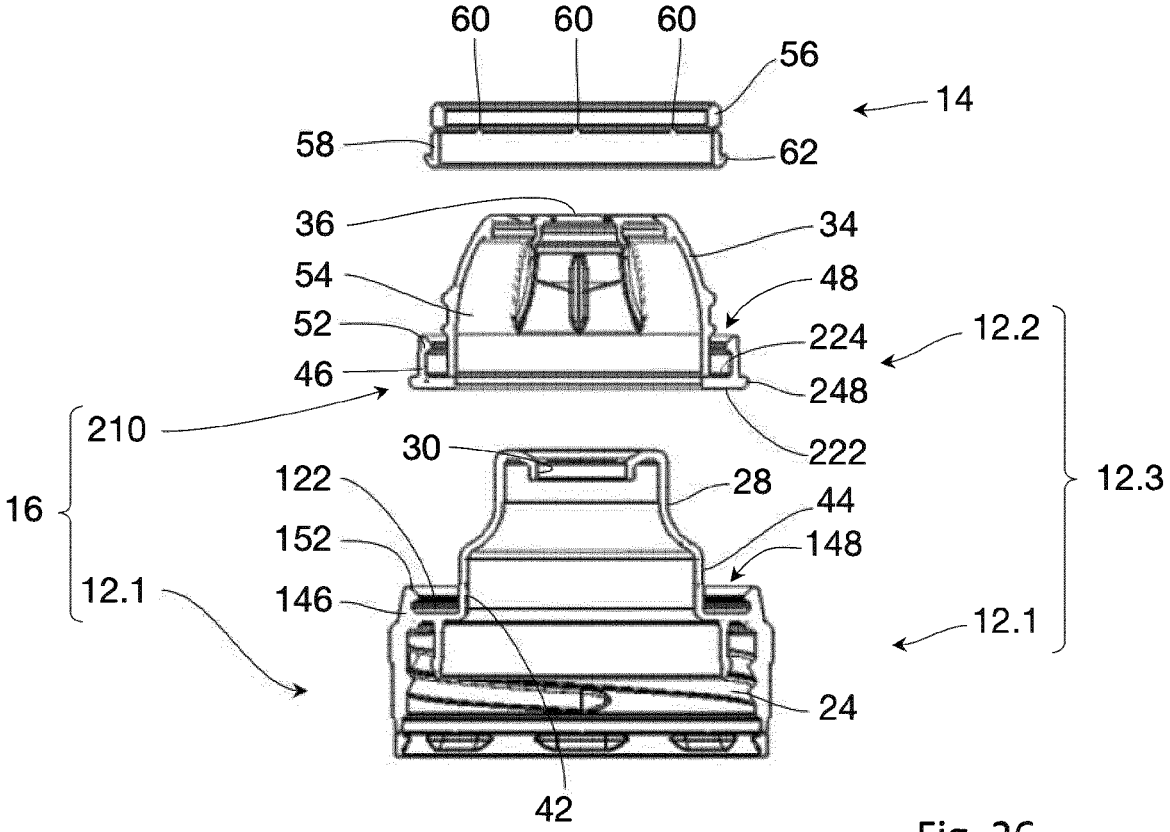
FIG. 26: shows a sectional view of the three parts of a container closure in accordance with the fifth embodiment of the invention.
Figure 27:
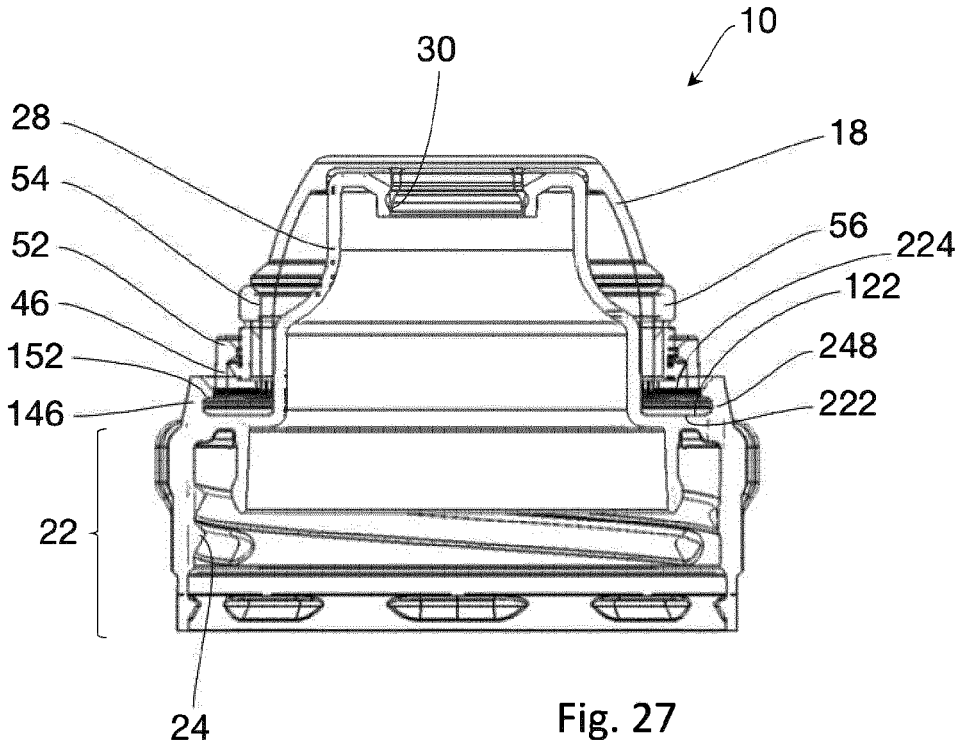
FIG. 27: shows a sectional view of the container closure in accordance with the fifth embodiment of the invention in a closed position in front of the first opening.

The container closure 10 in accordance with the fourth embodiment is shown in FIGS. 23 and 24, and differs from the second embodiment in that the container closure 10 has a spout piece 128 separate from the closure 12, which is mounted inside the attachment area 22 of the base part 16 and rests against a shoulder 68 of the attachment area which has a sealing collar 70. This spout piece 128 forms the spout area 28 of the container closure. The mounting of the spout piece 128 may occur before, after, or simultaneously with the mounting of the guarantee ring 14.

The container closure 10 in accordance with the fifth embodiment is shown in FIGS. 25 to 30, and comprises three separate parts, namely a base part 12.1, a head part 12.2 and a guarantee ring 14, wherein the base part 12.1 and the head piece 12.2 in the assembled state in FIGS. 27 to 30 form an assembly 12 which is substantially identical in form and function to the closure part 12 of the first embodiment.

The base piece 12.1 comprises a connection area 22 having a thread 24 for connection to a container neck, a pouring area 28 forming the drinking opening 31 of the container closure 10, and a curved hook wall 146 projecting axially from a flat upper bearing surface 122 of the attachment area 22 in the direction opposite to the thread 24 and extending through an angle preferably greater than 180°, in the example greater than 270° about the reference axis 100 of the container closure 10. The two circumferentially opposite ends of the hook wall 146 form two lateral stops 150 that circumferentially define a recess 120 of the base piece. The hook wall 146 has a radially inwardly projecting shoulder 152 and defines a notch 148 with the upper bearing surface 122 of the attachment area 22.

The head piece 12.2 has a cap part 18, a hinge 20, and an anchor ring 210 connected at a lower extension 212 of the hinge.

The anchor ring 210 comprises an annular flat lower bearing surface 222, an annular flat upper bearing surface 224 and an arcuate anchor projection 248, the dimensions of which correspond to the dimensions of the bearing surface 122, or the circumferential wall 146 and its shoulder 152, so that after mounting the anchor projection 248 behind the shoulder 152 engages positively or non-positively while the bearing surface 222 rests on the bearing surface 122 over a wide area, in such a way that there is no longer any possibility of movement between the anchor ring 210 and the base piece 12.1. positively/force-fit behind the shoulder 152 while the bearing surface 222 rests on the bearing surface 122 over a wide area, in such a way that there is no longer any possibility of movement between the anchor ring 210 and the base part 12.1, and that the anchor ring 210 and the base part 12.1 together form a base part 16 which has the same external shape as the base part 16 of the first embodiment.

Figure 28:
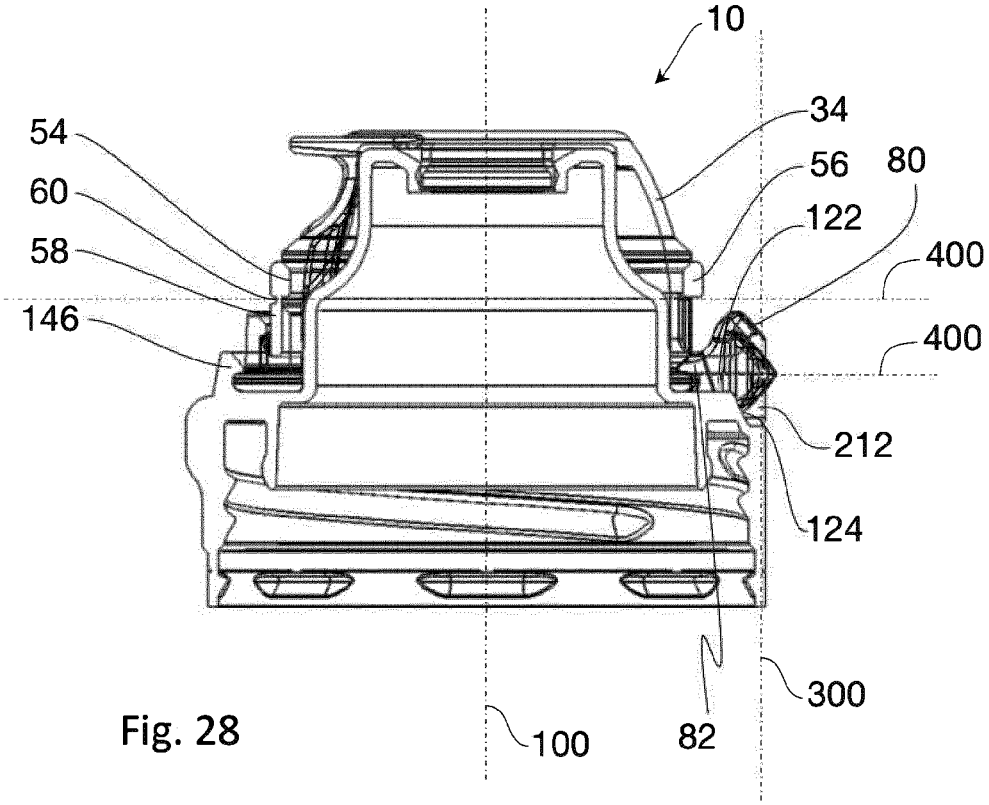
FIG. 28: shows a sectional view of the container closure in accordance with the fifth embodiment in the closed position in front of the first opening, through a second longitudinal sectional plane extending transversely to the sectional plane of FIG. 27.
Figure 29:
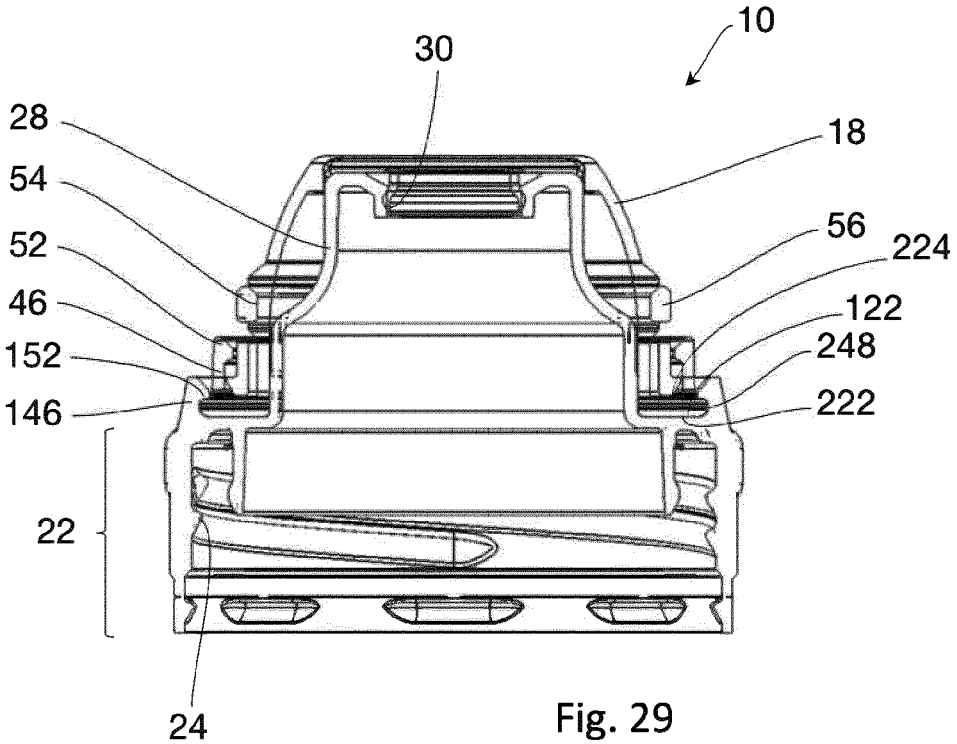
FIG. 29: shows a sectional view of the container closure in accordance with the fifth embodiment, in the closed position after the first opening.
Figure 30:
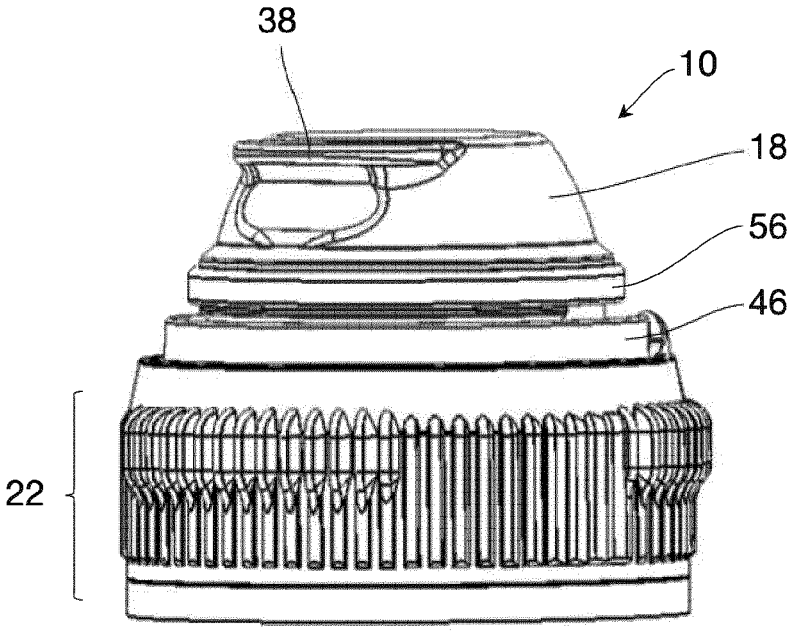
FIG. 30: shows a perspective view of the container closure in accordance with the fifth embodiment, in the closed position after the first opening.

The hinge 20 is shown here as a snap hinge and allows the cap part 18 to pivot about a pivot axis 200 that extends perpendicular to the sectional plane of FIG. 28. The offset 212 of the hinge 20 rests in the recess 120 on the bearing surface 122 and radially on a bearing surface 124 of the recess 120, and is held circumferentially against the lateral stops 150. The pivot axis 200 is the line of intersection between a transverse plane 400 extending between the bearing surface 122 and the annular notch 54 of the cap part 18 in the closed position, and an orthoradial plane 300 extending parallel to the reference axis 100 of the base part 16 and further from the reference axis 100 than the outer surface of the hook wall 146.

As in the other embodiments, the cap part 18 has an anchor wall 80 which extends radially outwardly from the outer wall 34 and is rigidly connected to the lower edge 41 of the cap part 18 by a bridge 82 of the cap part 18 extending radially outwardly from the lower edge 41 of the cap part 18, and to which the hinge 20 is connected.

After mounting, the head piece 12.2 and the base piece 12.1 together form an assembly 12.3 which has the same external shape and the same function as the closure piece 12 of the first embodiment, except that the two parts 12.1, 12.2 may be made of two different materials, or have different colors. It is possible, for example, to manufacture the head piece 12.2 from transparent or opaque polypropylene (PP) and the base piece 12.1 from high-density polyethylene (HDPE).

The anchor ring 210 has a curved hook wall 46 that extends through an angle preferably greater than 180°, in the example greater than 270° about the reference axis 100 of the container closure 10. The hook wall 46 has a radially inwardly projecting shoulder 52, which has the same shape and function as the shoulder 52 of the first embodiment, and after mounting is radially opposite the lower edge area 42 of the outer wall 34 of the cap part 18 and defines a cavity 48 with the latter and the upper bearing surface 224.

The guarantee ring 14 is identical to that of the first embodiment, to which reference is made for a detailed description.

The container closure 10 is produced as follows. The three parts 12.1,12.2,14 are produced separately by injection molding, with the head piece 12.2 in the open position of FIG. 13. In a first assembly step, the cap part 18 is brought into the closed position. Then, the closed head piece 12.2 is placed on the base piece 12.1 until the anchor protrusion 248 of the anchor ring 210 is fixed behind the shoulder 52. In a third assembly step, the guarantee ring 14 is placed on the cap part 18 by elastic deformation until the annular bead 56 enters the annular notch 54 and produces a form closure with the cap part 18, while the indicator part 58 partially enters the cavity 48 and the hook area 62 engages behind the shoulder 52 of the hook wall 46 of the anchor ring 16, as shown in FIGS. 15 and 16.

If necessary, the sequence of the three assembly steps can be changed. The cap part 18 can be brought into the closed position, for example, after the open head piece 12.2 has been placed on the base piece 12.1. The guarantee ring 14 can be placed on the open head piece 12.2 if necessary.

After mounting, the indicator part 58 is partially within an upper area of the cavity 48, radially between the hook wall 46 and the lower edge area 42 of the cap part 18, and partially out of the cavity 48 so as to remain partially radially visible in front of the first opening. When the container closure 10 is first moved from the closed position of FIGS. 27 and 28 to the open position, the indicator part 58 is held by the shoulder 52 and the collar 56 is held by the notch 54. The fracture point 60 breaks while the collar 56 remains in the notch 54 and the indicator part 58 falls into the lower area of the cavity 48 due to gravity. When the container closure 10 is returned to the closed position of FIGS. 29 and 30 after the first opening, the indicator part 58 remains in the lower area of the cavity 48 on the upper bearing surface 224 of the anchor ring 210, where it is entirely covered by the hook wall 46 of the base part 16. This ensures a non-reversible and visible change to the container closure 10. The indicator part 58 remains trapped within the cavity 48.

Where appropriate, the hook wall of the anchor ring may have recesses or windows, which may correspond to recesses in the hook wall of the base piece and through which the cavity may be seen before the fracture is separated and the indicator part may be seen after the fracture is separated.

Other variants are foreseen. The outer guarantee ring 12 according to the invention can be applied to a container closure having a closure piece 12 and a spout piece 128, wherein the closure piece 12 has a base part 16 and a cap part 18 which are injection molded in the closed position, and the spout piece 128 is inserted into the closed closure piece 12.

The invention claimed is:

1. A container closure comprising:

a base part, a pouring area having a peripheral wall extending about a reference axis of the container closure and extending axially from the base part to a peripheral top edge of the pouring area surrounding a drinking opening, a cap part connected to the base part by a hinge and rotatable back and forth between a closed position and an open position about a pivot axis extending perpendicular to the reference axis, wherein the cap part has a base and a peripheral outer wall surrounding an inner surface of the base and extending axially from the base to a circumferential lower edge of the cap part, wherein the peripheral outer wall and the base of the cap part together surround and cover the pouring area in the closed position, wherein the cap part has an anchor wall which extends outside the peripheral outer wall at a radial distance from the peripheral outer wall and is rigidly connected to the lower edge of the cap part by a bridge of the cap part extending radially outwardly from the lower edge of the cap part, wherein, in the closed position, the anchor wall projects from the bridge in a direction opposite the base part and the hinge is connected to the anchor wall and extends from the anchor wall toward the base part, and wherein a channel is formed by the anchor wall, the bridge and a surface of the peripheral outer wall opposite the bridge, wherein the channel extends in a circumferential direction between two channel ends and is open in a direction opposite the base part between the channel ends, as well as in the circumferential direction at the two channel ends.

2. The container closure according to claim 1, wherein the bridge has a flat contact surface which, in the closed position, faces a flat surface of the base part.

3. The container closure claim 1, wherein the cap part, in the open position, is located on a side opposite the pouring area of an orthoradial reference plane of the container closure which contains the pivot axis and extends parallel to the reference axis.

4. The container closure according to claim 1, wherein the hinge is a bistable snap hinge.

5. The container closure according to claim 1, wherein the hinge is connected to a ridge free standing in a recess of the anchor wall.

6. The container closure according to claim 1, wherein the hinge is connected to a ridge free standing in a recess of the base part.

7. The container closure according to claim 1, wherein the peripheral outer wall of the cap part has a circumferential sealing surface which, in the closed position, abuts a circumferential sealing surface of a connection area between the pouring area and the base part.

8. The container closure according to claim 7, wherein, in the closed position, a circumferential line of contact between the circumferential sealing surface of the cap part and the circumferential sealing surface of the connection area has a distance from a cross-sectional plane containing the pivot axis and extending perpendicular to the reference axis that is less than one-third of the distance of the top edge of the pouring area from the cross-sectional plane.

9. The container closure according to claim 8, wherein the circumferential line of contact has a diameter greater than the distance of the top edge of the pouring area from the cross-sectional plane.

10. The container closure according to claim 8, wherein the circumferential contact line has a distance to an orthoradial reference plane containing the pivot axis and extending parallel to the reference axis, which distance is greater than the distance of the circumferential contact line to the cross-sectional plane.

11. The container closure according to claim 1, wherein the cap part has an inner circumferential centering bead which, in the closed position, surrounds and contacts the top edge of the pouring area.

12. The container closure according to claim 11, wherein in the closed position the centering bead has a circumferential contact surface with the top edge of the pouring area.

13. The container closure according to claim 1, wherein the cap part has an inner sealing skirt which extends axially from the inner surface of the base of the cap part and, in the closed position, comes into contact with an inner annular fold of the peripheral wall of the pouring area and seals the drinking opening.

14. The container closure according to claim 1, wherein the cap part is integrally designed with the hinge and the base part.

15. The container closure according to claim 1, wherein the pouring area is integrally designed with the base part.

16. The container closure according to claim 1, wherein the pouring area is separate from the base part.

17. The container closure according to claim 16, wherein the base part has a base piece and an anchor ring that engages an annular notch of the base piece, wherein the anchor ring is integrally designed with the hinge and the cap part.

18. The container closure according to claim 2, wherein the flat contact surface of the bridge, in the closed position, comes into contact with the flat surface of the base part.

19. The container closure according to claim 5, wherein the ridge is flexible.

20. The container closure according to claim 6, wherein the ridge is flexible.

* * * * *